US011610710B2

(12) United States Patent
Chatani et al.

(10) Patent No.: US 11,610,710 B2
(45) Date of Patent: Mar. 21, 2023

(54) MAGNETIC CORE, INDUCTOR AND MODULE INCLUDING INDUCTOR

(71) Applicant: TOKIN CORPORATION, Sendai (JP)

(72) Inventors: Kenichi Chatani, Sendai (JP); Kenji Ikeda, Sendai (JP); Toshinori Tsuda, Sendai (JP)

(73) Assignee: TOKIN CORPORATION, Miyagi (JP)

( * ) Notice: Subject to any disclaimer, the term of this patent is extended or adjusted under 35 U.S.C. 154(b) by 636 days.

(21) Appl. No.: 16/705,053

(22) Filed: Dec. 5, 2019

(65) Prior Publication Data

US 2020/0111593 A1 Apr. 9, 2020

Related U.S. Application Data

(62) Division of application No. 14/171,694, filed on Feb. 3, 2014, now Pat. No. 10,546,678.

(30) Foreign Application Priority Data

Feb. 4, 2013 (JP) ..... 2013-019649
Sep. 25, 2013 (JP) ..... 2013-198965

(51) Int. Cl.
*H01F 17/00* (2006.01)
*H01F 1/147* (2006.01)
(Continued)

(52) U.S. Cl.
CPC ..... *H01F 17/0013* (2013.01); *H01F 1/14766* (2013.01); *H01F 1/14775* (2013.01);
(Continued)

(58) Field of Classification Search
None
See application file for complete search history.

(56) References Cited

U.S. PATENT DOCUMENTS 5,936,298 A * 8/1999 Capocelli ..... H01F 17/0033 257/758
6,284,060 B1 9/2001 Matsutani et al.
(Continued)

FOREIGN PATENT DOCUMENTS

JP 11176680 A 7/1999
JP 2002016167 A 1/2002
(Continued)

OTHER PUBLICATIONS

Machine Translation of JP 2002-289419 A. (Year: 2002).*
(Continued)

*Primary Examiner* — Kevin M Bernatz
(74) *Attorney, Agent, or Firm* — Holtz, Holtz & Volek PC

(57) ABSTRACT

A module includes a circuit board and an inductor. The circuit board has a facing surface and a rear surface which are located at opposite sides to each other in an up-down direction. The inductor has a magnetic core and a coil. The magnetic core is made of a soft magnetic metal material. The magnetic core has a facing surface and a radiating surface which are located at opposite sides to each other in the up-down direction. The facing surface of the magnetic core is arranged to face the facing surface of the circuit board in the up-down direction. The radiating surface of the magnetic core is arranged to be radiatable heat outward. The coil has a coil portion and a connection end. The coil portion winds, at least in part, the magnetic core. The connection end is connected to the facing surface of the circuit board.

15 Claims, 12 Drawing Sheets

(51) Int. Cl.
*H01F 27/255* (2006.01)
*H01F 27/22* (2006.01)
*B22F 3/11* (2006.01)

(52) U.S. Cl.
CPC ..... *H01F 1/14791* (2013.01); *H01F 17/0033* (2013.01); *H01F 27/22* (2013.01); *H01F 27/255* (2013.01); *B22F 3/11* (2013.01); *B22F 3/1103* (2013.01); *B22F 3/1109* (2013.01); *B22F 2003/1106* (2013.01); *Y10T 428/32* (2015.01)

(56) References Cited

U.S. PATENT DOCUMENTS

| | | | | |
|---|---|---|---|---|
| 7,847,669 | B2 * | 12/2010 | Ayazi | H01F 17/0006 336/200 |
| 8,284,010 | B2 | 10/2012 | Tsuji et al. | |
| 10,546,678 | B2 * | 1/2020 | Chatani | H01F 27/22 |
| 10,943,725 | B2 * | 3/2021 | Chatani | H01F 41/046 |
| 2002/0043303 | A1 | 4/2002 | Takemoto et al. | |
| 2003/0024607 | A1 | 2/2003 | Takemoto et al. | |
| 2005/0012652 | A1 * | 1/2005 | Wakayama | H01F 1/26 342/3 |
| 2005/0074600 | A1 * | 4/2005 | Ma | B82Y 25/00 427/128 |
| 2007/0109087 | A1 * | 5/2007 | Kawarai | H01F 17/04 336/200 |
| 2007/0230221 | A1 * | 10/2007 | Lim | H02M 3/158 336/200 |
| 2008/0186124 | A1 * | 8/2008 | Schaffer | H01F 27/2895 336/200 |
| 2010/0219928 | A1 * | 9/2010 | Alakula | B22F 3/06 425/78 |
| 2011/0050191 | A1 | 3/2011 | Tsuji et al. | |
| 2011/0227681 | A1 * | 9/2011 | MacLennan | H01F 27/10 336/57 |
| 2011/0242775 | A1 * | 10/2011 | Schaible | H01F 17/04 361/752 |
| 2012/0217614 | A1 * | 8/2012 | Burgyan | H01L 23/552 257/532 |
| 2013/0015939 | A1 | 1/2013 | Inagaki et al. | |
| 2017/0117081 | A1 * | 4/2017 | Chatani | H05K 9/0075 |
| 2022/0189686 | A1 * | 6/2022 | Wennerstrom | H01F 27/2823 |

FOREIGN PATENT DOCUMENTS

| | | | | |
|---|---|---|---|---|
| JP | 2002289419 | A * | 10/2002 | H01F 41/16 |
| JP | 2002289419 | A | 10/2002 | |
| JP | 2003203813 | A | 7/2003 | |
| JP | 2004247663 | A | 9/2004 | |
| JP | 2004349400 | A | 12/2004 | |
| JP | 2006019418 | A | 1/2006 | |
| JP | 2009188033 | A | 8/2009 | |
| JP | 2009218531 | A | 9/2009 | |
| JP | 2010087058 | A | 4/2010 | |
| JP | 2011054585 | A | 3/2011 | |
| JP | 2012239283 | A | 12/2012 | |
| WO | 2011118774 | A1 | 9/2011 | |

OTHER PUBLICATIONS

Chinese Office Action (and English translation thereof) dated Oct. 10, 2016, issued in counterpart Chinese Application No. 201410039157.5.

Japanese Office Action dated Mar. 22, 2018 issued in counterpart Japanese Application No. 2013-198965.

Japanese Office Action dated Sep. 6, 2017 which issued in counterpart Japanese Application No. 2013-198965.

Taiwanese Office Action (and English translation thereof) dated May 23, 2018, issued in counterpart Taiwanese Application No. 103103251.

* cited by examiner

MAGNETIC CORE, INDUCTOR AND MODULE INCLUDING INDUCTOR

CROSS REFERENCE TO RELATED APPLICATIONS

This application is a Divisional Application of U.S. application Ser. No. 14/171,694, filed Feb. 3, 2014, now U.S. Pat. No. 10,546,678, which claims priority under 35 U.S.C. § 119 of Japanese Patent Applications No. JP2013-019649 filed Feb. 4, 2013 and No. JP2013-198965 filed Sep. 25, 2013. The entire contents of all of the above-identified applications are incorporated herein by reference.

BACKGROUND OF THE INVENTION

This invention relates to a module comprising a circuit board and an inductor. For example, the module is a power module which is to be installed in an electronic apparatus to supply electric power. This invention also relates to a magnetic core and an inductor which are suitable for the module.

Generally, an electric component mounted on a circuit board, for example, a switching transistor, a power control Integrated Circuit (IC) or an inductor, generates heat. As the size of the circuit board is reduced, the heat per unit volume increases. Especially, an inductor tends to generate large heat. Accordingly, a module including a circuit board and an inductor is required to have a structure for efficiently radiating heat outward. For example, a module having such a structure is disclosed in Patent Document 1 (US A 2007/0230221), content of which is incorporated herein by reference.

The module of Patent Document 1 comprises an active layer (a circuit board) and a passive layer. The passive layer includes a Low Temperature Co-fired Ceramics (LTCC) inductor made of an LTCC. The circuit board is placed on the LTCC inductor via a heat spreader. Since the module is thus configured, heat generated by the LTCC inductor and the circuit board can be dissipated through the heat spreader.

Patent Document 2 (JP A 2002-289419) discloses a magnetic core formed of soft-magnetic-sintered-alloy layers and insulation layers which are stacked alternately on one another. The content of Patent Document 2 is incorporated herein by reference.

The module of Patent Document 1 is required to include the heat spreader in order to cool the LTCC inductor and the circuit board. Moreover, the module of Patent Document 1 is required to include a heat sink in order to more efficiently radiate the heat generated by the LTCC inductor and the circuit board. In other words, it is necessary to install the members for radiating the heat, namely, the heat spreader, the heat sink and so on, in the module. Accordingly, the module tends to have a complicated structure and a large size. Moreover, ceramics such as the LTCC is a brittle material. Accordingly, the LTCC inductor is easily damaged when pressed against the other member, for example, the member for radiating the heat. Moreover, as described in Patent Document 1, the LTCC inductor has low thermal conductivity. Accordingly, even when the module has the member for radiating the heat, it is difficult to radiate the heat sufficiently.

Moreover, the aforementioned drawback is not limited to the LTCC inductor. In general, although an inductor is a main heat generator in a module, an existing inductor has low thermal conductivity. Accordingly, it is difficult to efficiently radiate the heat generated by the inductor.

When an inductor is formed by using the magnetic core disclosed in Patent Document 2, it is necessary to form a window in each of the soft-magnetic-sintered-alloy layers and to form a through hole in each of the insulation layers. Moreover, it is necessary to stack the soft-magnetic-sintered-alloy layers and the insulation layers in such a manner that the windows and the through holes properly overlap one another. The aforementioned process is cumbersome. Thus, it is not easy to form an inductor having a shape and a size which are suitable for a module.

SUMMARY OF THE INVENTION

It is therefore an object of the present invention to provide a module having a simple structure which can efficiently radiate heat generated by an inductor. It is also an object of the present invention to provide a magnetic core and an inductor which are suitable for the module.

First aspect of the present invention provides a module comprising a circuit board and an inductor. The circuit board has a facing surface and a rear surface which are located at opposite sides to each other in an up-down direction. The inductor has a magnetic core and a coil. The magnetic core is made of a soft magnetic metal material. The magnetic core has a facing surface and a radiating surface which are located at opposite sides to each other in the up-down direction. The facing surface of the magnetic core is arranged to face the facing surface of the circuit board in the up-down direction. The radiating surface of the magnetic core is arranged to be radiatable heat outward. The coil has a coil portion and a connection end. The coil portion winds, at least in part, the magnetic core. The connection end is connected to the facing surface of the circuit board.

Second aspect of the present invention provides a magnetic core made of a soft magnetic metal powder having flat-like shape and bound by a binder component. The magnetic core has elasticity. The magnetic core includes the soft magnetic metal powder of 60 vol % or more and vacancy between 10 vol % and 25 vol %, both inclusive. The binder component includes a silicon oxide as a principal component.

Third aspect of the present invention provides an inductor comprising the magnetic core of the second aspect and a coil. The coil has a coil portion and a connection end.

The magnetic core of the inductor of the module according to the first aspect of the present invention is made of the soft magnetic metal material. Accordingly, the thermal conductivity of the magnetic core can be improved by increasing the volume filling ratio (volume ratio) of the soft magnetic metal material. Moreover, since the radiating surface of the magnetic core, whose thermal conductivity can be thus-improved, is arranged to be radiatable heat outward, the heat generated by the inductor can be efficiently radiated. Moreover, since the magnetic core according to the second aspect of the present invention has elasticity, the magnetic core can be processed easily. Accordingly, it is relatively easy to form the magnetic core and the inductor each of which have a size and a shape suitable for the module.

An appreciation of the objectives of the present invention and a more complete understanding of its structure may be had by studying the following description of the preferred embodiment and by referring to the accompanying drawings.

Figure 1:
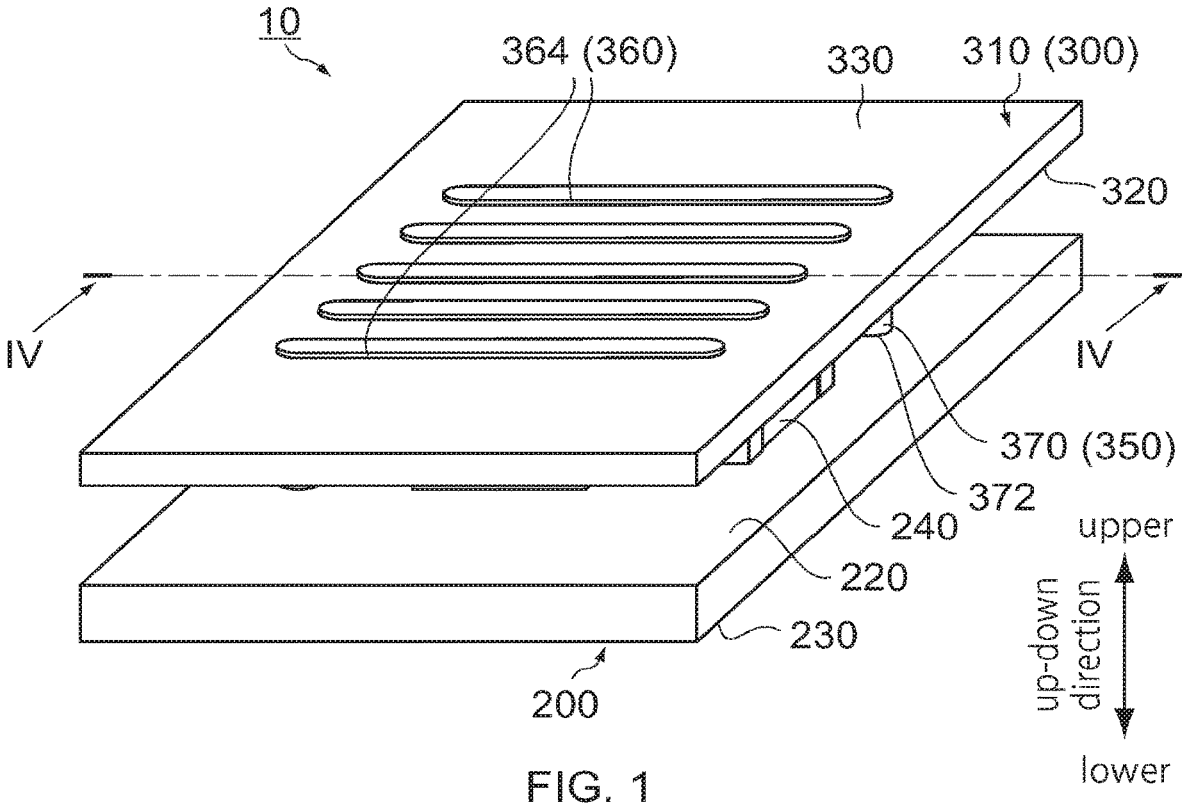
FIG. 1 is a perspective view schematically showing a module according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

In the following explanation, a word indicating a position, for example, "upper" or "lower", does not show absolute position but only shows a relative position in a Figure.

First Embodiment

As shown in FIG. 1, a module (power module) 10 according to a first embodiment of the present invention comprises a circuit board 200 and an inductor 300. The module 10 according to the present embodiment is a power module which is to be installed, for example, in an electronic apparatus (not shown) to supply electric power outward of the module 10. However, the present invention is applicable to a module other than the power module 10.

As shown in FIGS. 1 to 4, the circuit board 200 has a facing surface 220 and a rear surface 230 which are located at opposite sides to each other in an up-down direction. Each of the facing surface 220 and the rear surface 230 according to the present embodiment is a horizontal plane perpendicular to the up-down direction.

Figure 2:
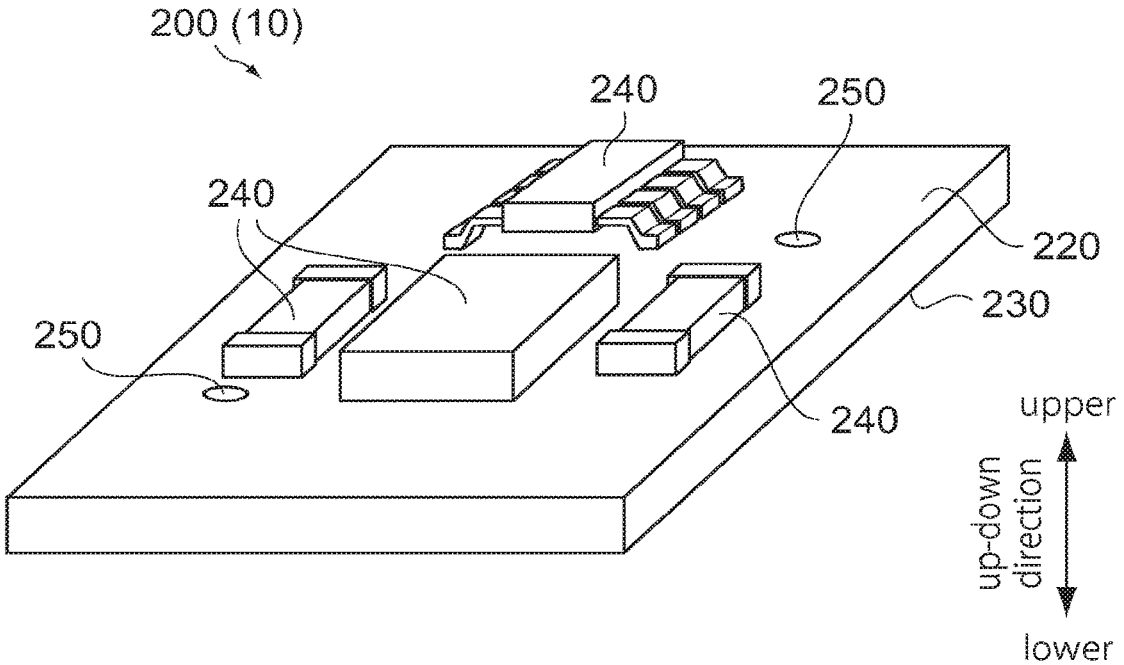
FIG. 2 is a perspective view showing a circuit board of the module of FIG. 1.

As shown in FIG. 2, the module 10 is provided with electronic components 240 such as a switching transistor, a power control IC, a capacitor and so on. According to the present embodiment, the electronic components 240 are mounted on the facing surface 220, while any electronic component 240 is not mounted on the rear surface 230. More specifically, the rear surface 230 is uniformly plated. However, the circuit board 200 may be formed differently. For example, the electronic components 240 may be mounted on the rear surface 230, while the facing surface 220 may be uniformly plated. In other words, any electronic component 240 may not be mounted on the facing surface 220.

The facing surface 220 is formed with signal lines (not shown) each made of a conductor. The electronic components 240 are connected to one another via the signal lines. Moreover, the facing surface 220 is formed with two connection portions 250. Each of the connection portions 250 is connected to the signal line.

As shown in FIGS. 1 and 3 to 5, the inductor 300 has a magnetic core 310 and a coil 350 made of a material having high thermal conductivity, or a metal.

Figure 5:
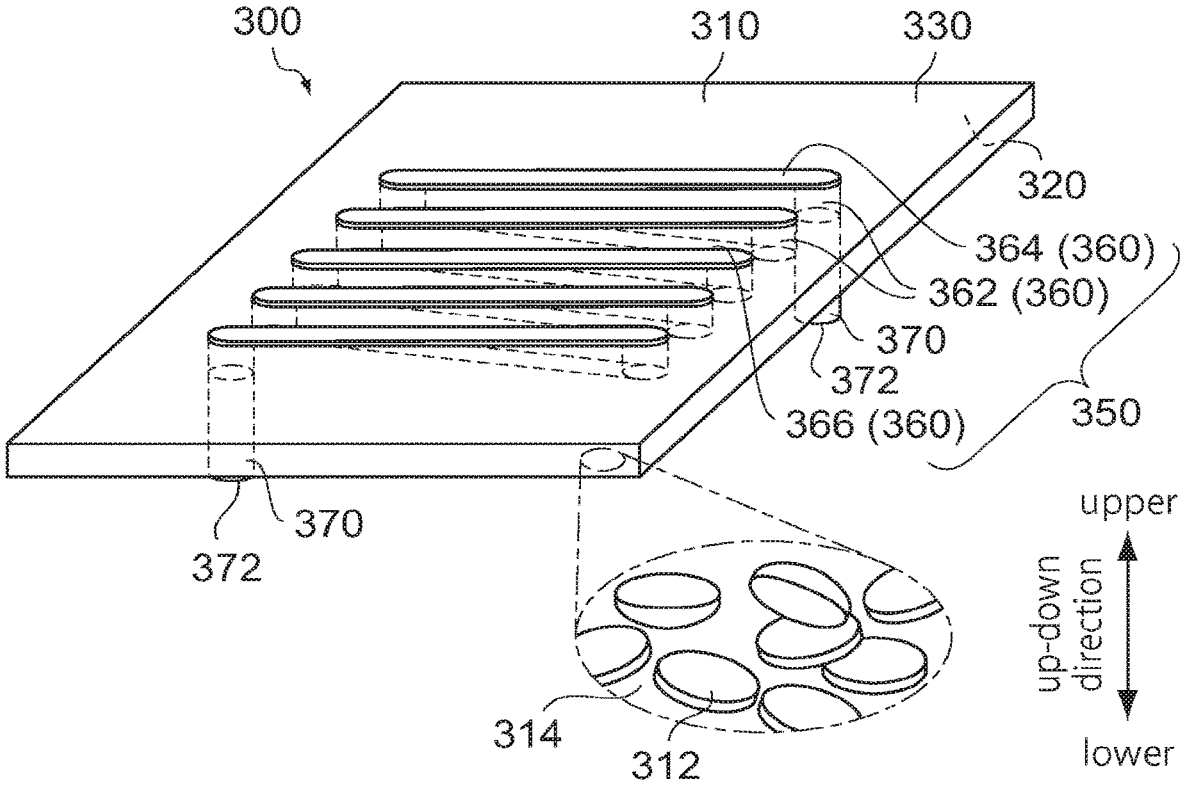
FIG. 5 is a perspective view showing an inductor of the module of FIG. 1, wherein hidden parts of a coil of the inductor are illustrated by dotted line, and wherein a material of a magnetic core of the inductor is schematically illustrated in an ellipse drawn by chain dotted line.

As shown in FIG. 5, the magnetic core 310 according to the present embodiment is made by using a soft magnetic metal material (soft magnetic metal powder) 312. In detail, the magnetic core 310 mainly formed of the soft magnetic metal powder 312 having flat-like shape and a binder (insulating material) 314 made of an insulating resin. The magnetic core 310 can be formed by binding particles of the soft magnetic metal powder 312 by the binder 314. For example, the soft magnetic metal powder 312 is mixed with a solvent, a viscosity improver and a thermoset binder component, or the binder 314 to form slurry. The slurry is applied and heated so that the solvent is volatilized. The thus-treated slurry can be used as a material or a component of the magnetic core 310.

The magnetic core 310 according to the present embodiment has high electric resistivity because the particles of the soft magnetic metal powder 312 are bound by the binder 314, or the insulator. Specifically, the magnetic core 310 has electric resistivity of 10 KΩ·cm or more. In other words, the magnetic core 310 has a satisfactory insulation property. Accordingly, the magnetic core 310 can be directly in contact with a conductor. Moreover, the magnetic core 310 according to the present embodiment has high strength and certain elasticity. In other words, the magnetic core 310 is formed to be elastically deformable.

Since the magnetic core 310 according to the present embodiment is formed as described above, each of a saturation magnetic flux density, relative permeability and thermal conductivity of the magnetic core 310 can be improved by increasing a volume filling ratio (volume ratio) of the soft magnetic metal powder 312, or the metal material. Specifically, in order to obtain sufficient thermal conductivity while keeping sufficient magnetic characteristics, it is preferable that the magnetic core 310 include the soft magnetic metal powder 312 between 55 vol % and 85 vol %, both inclusive. When the volume ratio of the soft magnetic metal powder 312 is in the aforementioned range, all of the high saturation magnetic flux density, the high relative permeability and the high thermal conductivity can be obtained. On the other hand, if the volume ratio of the soft magnetic metal powder 312 is more than 85 vol %, the electrical resistivity is drastically lowered so that eddy current loss within the inductor 300 becomes large.

Since the magnetic core 310 according to the present embodiment includes the soft magnetic metal powder 312 of 55 vol % or more, the magnetic core 310 has the high saturation magnetic flux density, the high relative permeability and the high thermal conductivity. In order to further heighten the relative permeability of the magnetic core 310, it is preferable that the magnetic core 310 include the soft magnetic metal powder 312 of 60 vol % or more, and it is more preferable that the magnetic core 310 includes the soft magnetic metal powder 312 of 70 vol % or more.

The magnetic core 310 according to the present embodiment has equivalent or superior magnetic characteristics even in comparison with a ferrite magnetic core made of a ferrite. More specifically, the magnetic core 310 has an inductance and the electric resistivity equivalent to those of the ferrite magnetic core and superimposed Direct Current (DC) characteristic superior to the ferrite magnetic core. Moreover, the magnetic core 310 has the thermal conductivity higher than that of the ferrite magnetic core which is conventionally considered to be the best magnetic core. Moreover, unlike the ferrite magnetic core, even when the magnetic core 310 receives a pressing force, the magnetic core 310 is hardly to be damaged, and the magnetic characteristics of the magnetic core 310 are hardly to be degraded. As can be seen from the above explanation, the magnetic core 310 according to the present embodiment is especially suitable to the inductor 300 of the power module 10 that is supplied with a large current.

The magnetic core 310 having the high thermal conductivity may be formed by a method different from the present embodiment, provided that the magnetic core 310 is formed of a soft magnetic metal material. For example, the magnetic core 310 can be formed as described below. At first, a thin metal film made of a Zr—Co—Ta based alloy, a permalloy or the like is formed on an insulating layer by sputtering method. Then, the insulating layer which is thus formed with the thin metal film is used as a component of a magnetic core. Specifically, several ten or more of the thus-formed components are stacked on one another so that a magnetic core having a thickness of about 1 mm and high thermal conductivity is formed.

Figure 6:
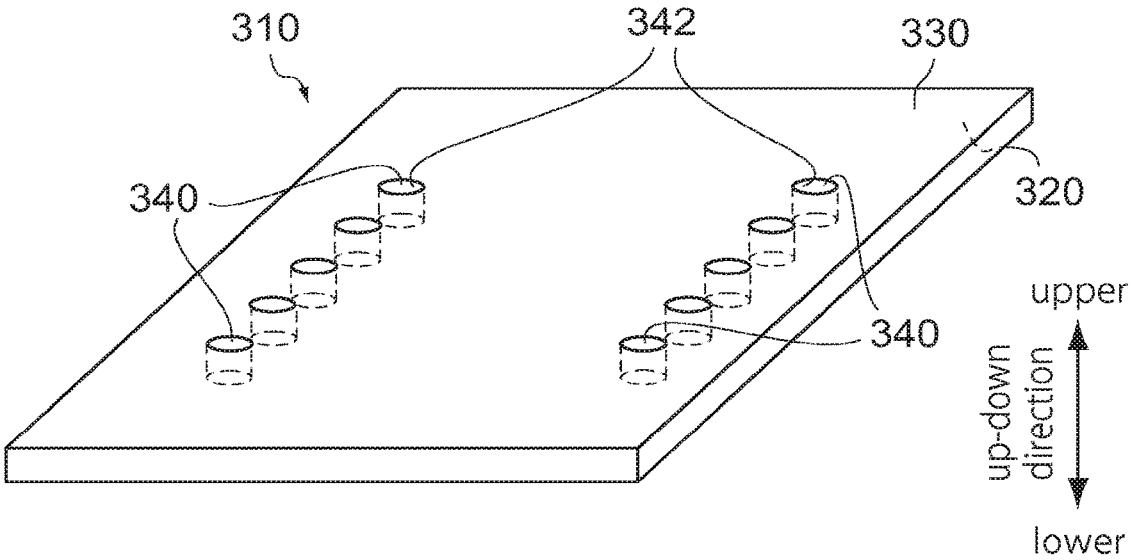
FIG. 6 is a perspective view showing the magnetic core of the inductor of FIG. 5, wherein hidden parts of through holes of the magnetic core are illustrated by dotted line.

As shown in FIGS. 1, 5 and 6, the magnetic core 310 has a plate-like shape. In detail, the magnetic core 310 has a facing surface 320 and a radiating surface 330 which are located at opposite sides to each other in the up-down direction. Each of the facing surface 320 and the radiating surface 330 according to the present embodiment is a horizontal plane perpendicular to the up-down direction. The magnetic core 310 is formed with a plurality of through holes 340 arranged in two rows. In detail, the magnetic core 310 according to the present embodiment is formed with two through-hole groups each including five of the through holes 340 arranged in a row. Each of the through holes 340 has a cylindrical shape which pierces the magnetic core 310 in the up-down direction. The through hole 340 is formed with an inner wall 342 (see FIG. 6).

Figure 7:
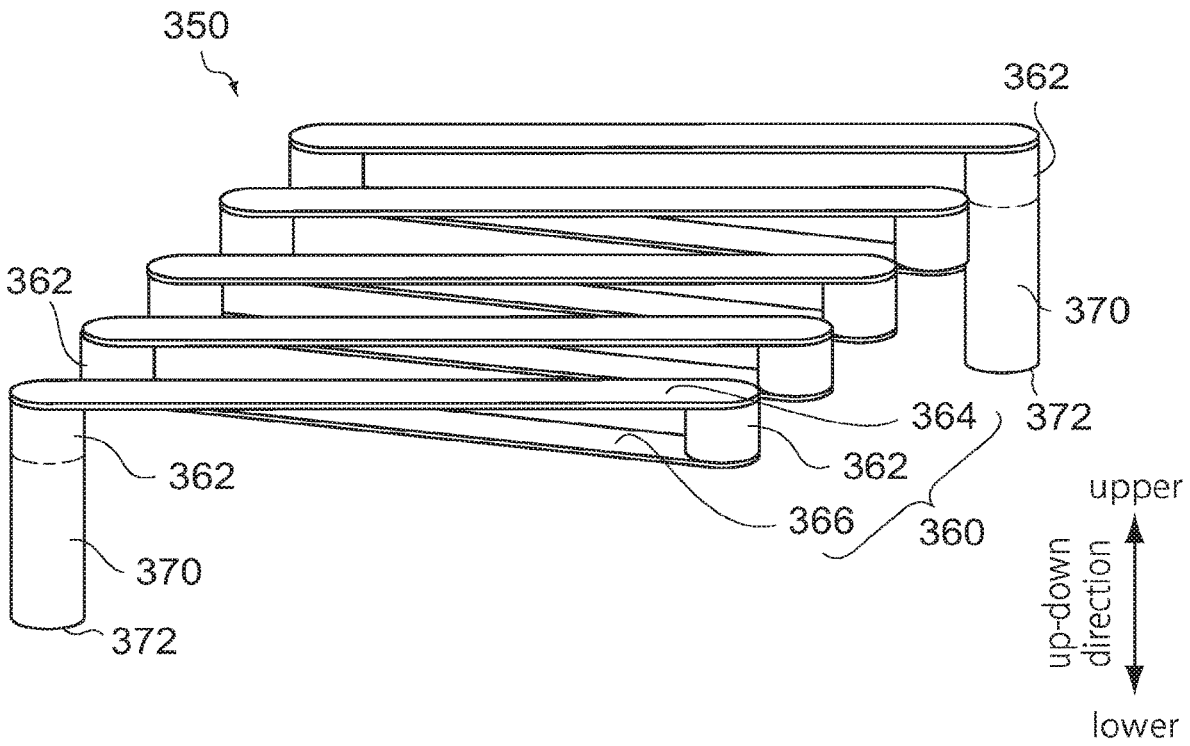
FIG. 7 is a perspective view showing the coil of the inductor of FIG. 5, wherein imaginary lines, each of which is a boundary line between a piercing portion and a connection portion of the coil, are illustrated by chain dotted line.

As shown in FIGS. 5 and 7, the coil 350 has a coil portion 360 and two connection portions 370. The coil portion 360 has a plurality of piercing portions (via conductors) 362, a plurality of first coupling portions (coupling conductors) 364 and a plurality of second coupling portions (coupling conductors) 366.

The piercing portions 362 are inserted in the respective through holes 340 of the magnetic core 310. Thus, according to the present embodiment, the coil portion 360 has two piercing-portion groups each including five of the piercing portions 362 arranged in a row. The first coupling portion 364 couples an upper end of the piercing portion 362 included in one of the piercing-portion groups and an upper end of the piercing portion 362 included in remaining one of the piercing-portion groups with each other. The second coupling portion 366 couples a lower end of the piercing portion 362 included in one of the piercing-portion groups and a lower end of the piercing portion 362 included in remaining one of the piercing-portion groups with each other. Thus, the piercing portions 362, the first coupling portions 364 and the second coupling portions 366 are connected to one another so as to wind a part of the magnetic core 310. In other words, the coil portion 360 winds, at least in part, the magnetic core 310.

Referring to FIGS. 2 to 5, two of the piercing portions 362, which are farthest from each other in the piercing portions 362, extend long downward from the through holes 340 to be formed with the respective connection portions 370. The connection portion 370 has a connection end 372 formed at a lower end thereof. Thus, the coil 350 has the two connection ends 372. The connection ends 372 are connected to the respective connection portions 250 of the facing surface 220 of the circuit board 200 so that the coil 350 is electrically connected to the electronic components 240 via the signal lines (not shown) on the circuit board 200.

Figure 8A:
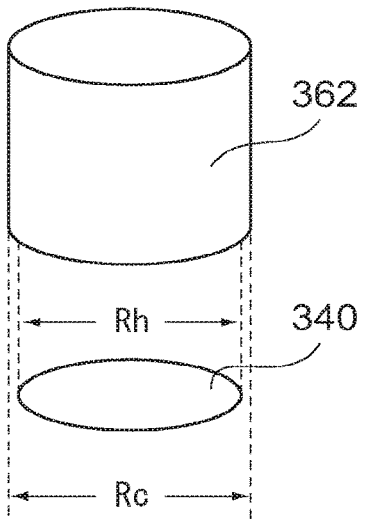
FIG. 8A is a partially enlarged, perspective view showing the through hole of the magnetic core and the piercing portion of the coil of FIG. 5, wherein the piercing portion is not yet inserted in the through hole.
Figure 8B:
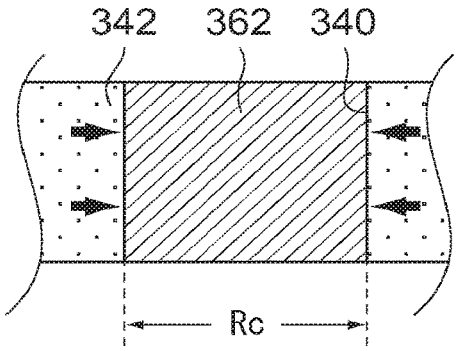
FIG. 8B is a partially enlarged, side, cross-sectional view showing the through hole of the magnetic core and the piercing portion of the coil of FIG. 5.

As shown in FIGS. 8A and 8B, the piercing portion 362 according to the present embodiment has a cylindrical shape similar to the through hole 340. However, a diameter Rc of the piercing portion 362 is slightly larger than a diameter Rh of the through hole 340. Since the magnetic core 310 according to the present embodiment has the elasticity, the piercing portion 362 can be inserted into the through hole 340 even when the diameter Rc is larger than the diameter Rh. Moreover, when the diameter Rc is almost same as the diameter Rh, the piercing portion 362 can be pressed to spread outward to have an enlarged diameter after inserted in the through hole 340.

The piercing portion 362 of the coil portion 360, which is inserted in the through hole 340 as described above, pierces the through hole 340 while elastically deforming the inner wall 342 of the through hole 340. The elastically deformed inner wall 342 applies a pressing force, or an elastic force to the piercing portion 362 of the coil portion 360. Accordingly, the coil 350 is held by the pressing force which is applied from the inner wall 342 of the through hole 340 to the piercing portion 362 of the coil portion 360.

As can be seen from the above explanation, the magnetic core 310 according to the present embodiment has the proper elasticity that not only allows the insertion of the piercing portion 362 having the diameter larger than the through hole 340 but also enables secure holding of the inserted piercing portion 362. Accordingly, the magnetic core 310 can hold the coil 350 only by the elastic force, or the pressing force of the inner wall 342. Moreover, the piercing portion 362 and the through hole 340 may be fixed to each other by an adhesive filled therebetween after the coil 350 is temporally held by the through hole 340. Even if the elastic force of the inner wall 342 is relatively small, the coil 350 can be held securely by the thus-filled adhesive. Thus, according to the present embodiment, the coil 350 can be held only by the through hole 340.

Figure 9A:
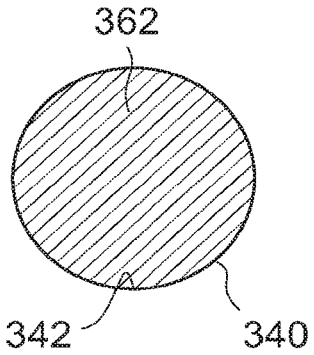
FIG. 9A is a partially enlarged, plan, cross-sectional view showing the through hole of the magnetic core and the piercing portion of the coil of FIG. 5.
Figure 9B:
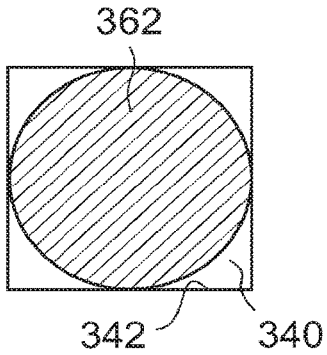
FIG. 9B is a plan, cross-sectional view showing a modification of the through hole and the piercing portion of FIG. 9A.
Figure 9C:
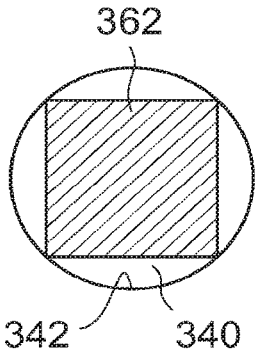
FIG. 9C is a plan, cross-sectional view showing another modification of the through hole and the piercing portion of FIG. 9A.

As shown in FIG. 9A, according to the present embodiment, each of the piercing portion 362 and the through hole 340 has a circular cross-section. Accordingly, the piercing portion 362 inserted in the through hole 340 is securely held by the whole surface of the inner wall 342 of the through hole 340. However, each of the piercing portion 362 and the through hole 340 may have a cross-section of another shape, provided that the piercing portion 362 is held by the inner wall 342 at two or more points. For example, as shown in FIG. 9B, the piercing portion 362 may have a circular cross-section, while the through hole 340 may have a rectangular cross-section. Moreover, as shown in FIG. 9C, the piercing portion 362 may have a rectangular cross-section, while the through hole 340 may have a circular cross-section. However, in order to more securely hold the piercing portion 362, it is preferable that the piercing portion 362 and the through hole 340 be configured similar to the present embodiment.

Figure 3:
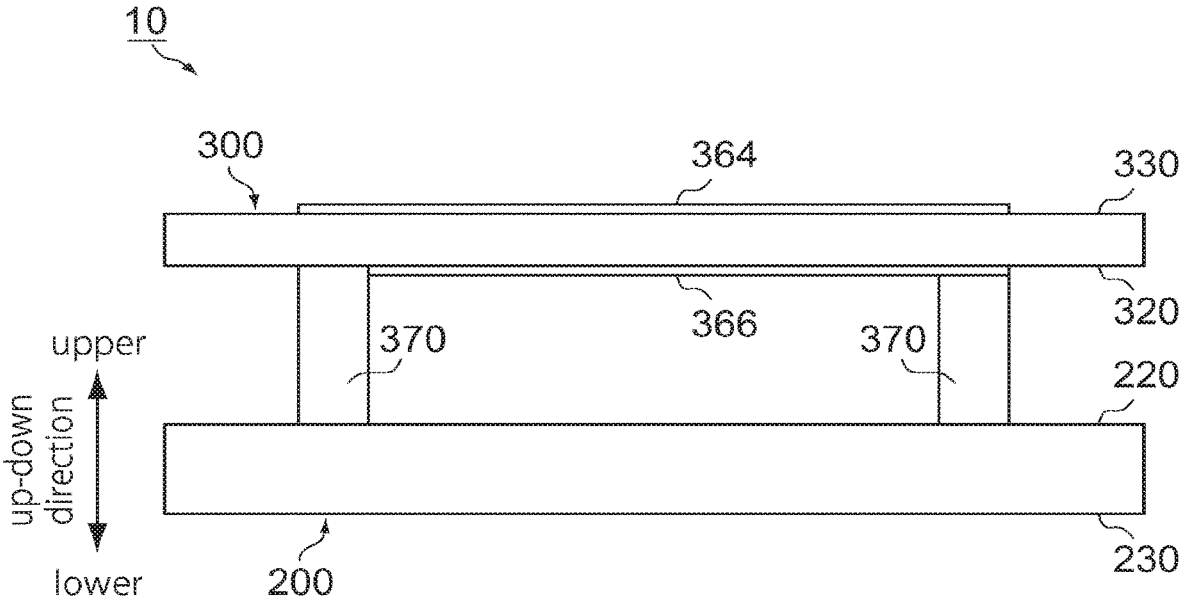
FIG. 3 is a side view showing the module of FIG. 1, wherein electronic components mounted on the circuit board of the module are not illustrated.
Figure 4:
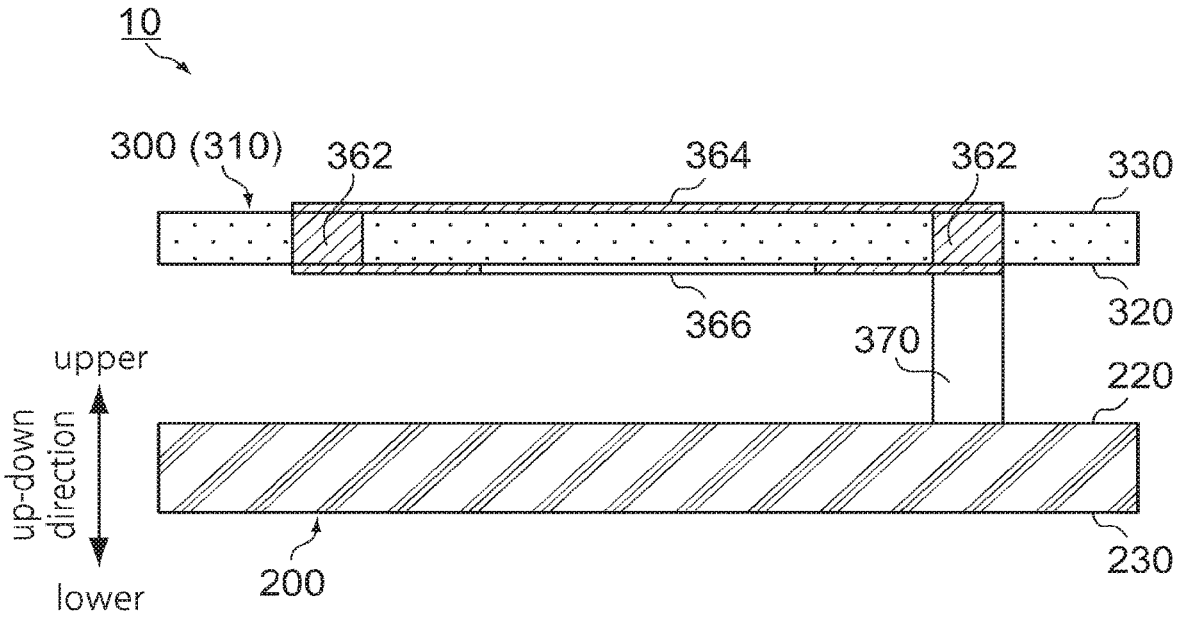
FIG. 4 is a cross-sectional view showing the module of FIG. 1, taken along line IV-IV, wherein the electronic components mounted on the circuit board of the module are not illustrated.

As shown in FIGS. 1, 3 and 4, the facing surface 320 of the magnetic core 310 of the inductor 300 configured as described above is arranged to face the facing surface 220 of the circuit board 200 in the up-down direction. The facing surface 320 and the facing surface 220 are coupled with each other by the coil 350 having the high thermal conductivity. Moreover, the radiating surface 330 of the magnetic core 310 is exposed outward of the module 10.

Because the module 10 is configured as described above, the module 10 can conduct heat, which is generated by the circuit board 200, from the facing surface 220 to the facing surface 320 of the magnetic core 310 mostly via the connection portions 370 of the coil 350. Since the magnetic core 310 has the high thermal conductivity, the heat received by the facing surface 320 is effectively conducted to the radiating surface 330 together with heat generated by the inductor 300. The heat conducted to the radiating surface 330 can be radiated outward of the module 10. As can be seen from the above explanation, when the radiating surface 330 of the magnetic core 310 is exposed, at least in part, outward of the module 10, the heat radiating outward of the module 10 is accelerated so that the module 10 can be cooled efficiently.

According to the present embodiment, the inductor 300, which generates large heat, can be used as a member for radiating heat. Accordingly, the heat generated by the circuit board 200 and the inductor 300 can be radiated without providing a member for radiating heat such as a heat radiation plate between the facing surface 220 of the circuit board 200 and the facing surface 320 of the inductor 300. According to the present embodiment, the module 10 can be cooled efficiently while having a reduced size.

According to the present embodiment, the facing surface 320 of the magnetic core 310 and the facing surface 220 of the circuit board 200 are connected to each other only by the connection portions 370 of the coil 350. However, the magnetic core 310 and the circuit board 200 may be connected to each other by another member in addition to the coil 350. For example, the magnetic core 310 and the circuit board 200 may be connected to each other by a metal member having high thermal conductivity such as a copper or an aluminum. When the module 10 is thus configured, the inductor 300 can be more securely fixed to the circuit board 200, and the number of heat radiation paths can be increased.

According to the present embodiment, the radiating surface 330 is entirely exposed outward of the module 10. However, the radiating surface 330 may be covered by another member, provided that the heat is radiatable outward. For example, a part or the whole of the radiating surface 330 may be coated with a thin resin. Moreover, the outer circumference of the inductor 300 may be covered by a resin or a metal. Moreover, the outer circumference of the module 10 can be covered by a resin or a metal.

The radiating surface 330 may be in contact, at least in part, with a cooling member outside of the module 10, for example, a heat sink. As previously described, even when the magnetic core 310 receives the pressing force, the magnetic core 310 is hardly to be damaged, and the magnetic characteristics of the magnetic core 310 are hardly to be degraded. Accordingly, the outside cooling member can be closely attached to the radiating surface 330 by a high pressing force. When the module 10 is thus configured, the module 10 can be more efficiently cooled. As can be seen from the above explanation, when the radiating surface 330, which is one of the surfaces of the magnetic core 310 having the high thermal conductivity, is arranged to be radiatable heat outward, the heat generated by the circuit board 200 and the inductor 300 can be efficiently radiated.

Second Embodiment

Figure 10:
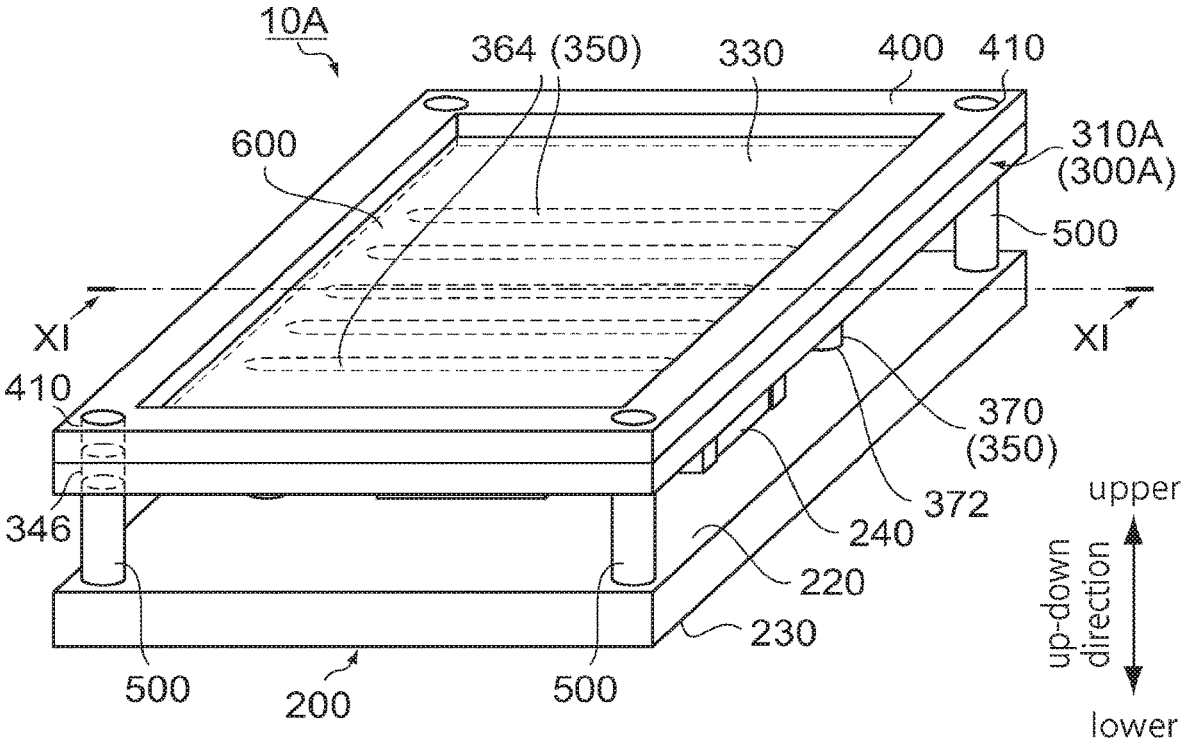
FIG. 10 is a perspective view schematically showing a module according to a second embodiment of the present invention, wherein hidden first coupling portions of the coil are illustrated by dotted line, and wherein one of hidden holding holes of the module is also illustrated by dotted line.

As can be seen from FIGS. 1 and 10, a module (power module) 10A according to a second embodiment of the present invention is a modification of the module 10 according to the first embodiment (see FIG. 1). The module 10A comprises the circuit board 200 same as that of the module 10, an inductor 300A which is slightly different from the inductor 300 of module 10. Moreover, the module 10A comprises a radiating member 400, a plurality of (according to the present embodiment, four) coupling members 500 and a coating 600, which are not included in the module 10. Hereafter, explanation is mainly made about different points between the module 10A and the module 10.

Figure 11:
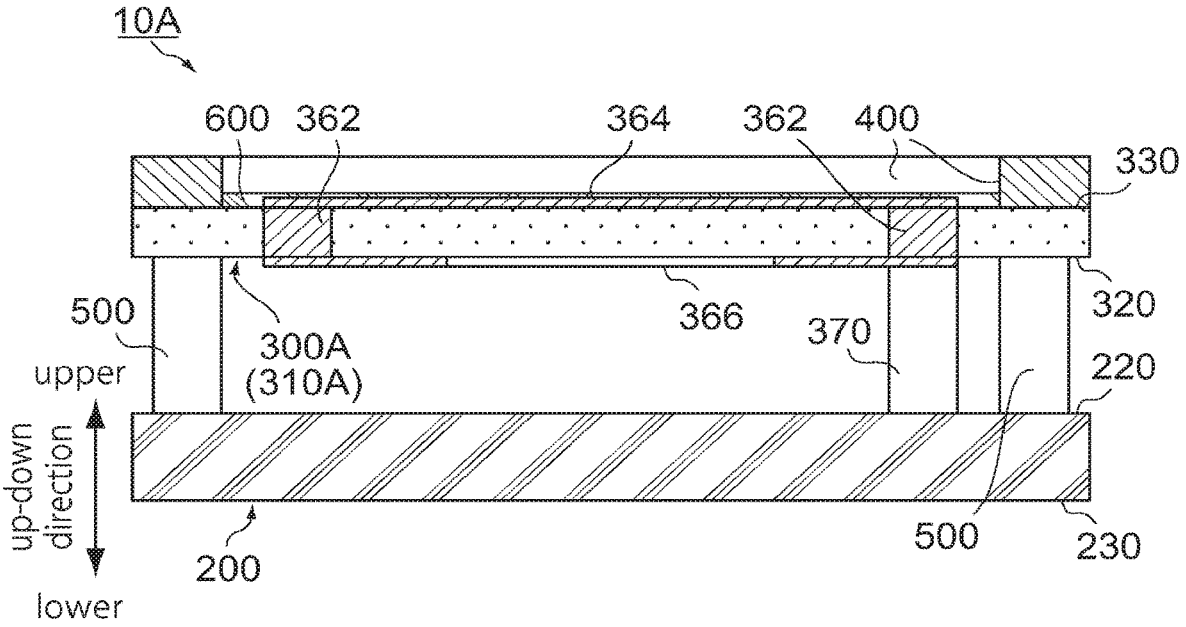
FIG. 11 is a cross-sectional view showing the module of FIG. 10, taken along line XI-XI, wherein the electronic components mounted on the circuit board of the module are not illustrated.

As shown in FIGS. 10 and 11, the inductor 300A has a magnetic core 310A and the coil 350. The magnetic core 310A has the almost same structure as the magnetic core 310 (see FIG. 6). However, the magnetic core 310A is formed with four holding holes 346. The holding holes 346 are formed at four corners of the magnetic core 310A, respectively. Each of the holding holes 346 pierces the magnetic core 310A in the up-down direction.

The radiating member 400 is formed of a thermal conductor having superior thermal conductivity such as a metal to have a rectangular frame-like shape. The radiating member 400 is attached to the radiating surface 330 of the magnetic core 310A. Since the magnetic core 310A has high electric resistivity, the radiating member 400 made of a metal can be in contact with the radiating surface 330 without insulation. Moreover, since the magnetic core 310A is made of a material similar to that of the magnetic core 310 (see FIG. 6), the magnetic core 310A is hardly to be damaged, and the magnetic characteristics of the magnetic core 310A are hardly to be degraded even when the magnetic core 310A receives a pressing force. Accordingly, the radiating member 400 can be closely attached to the magnetic core 310A by a high pressing force.

The radiating member 400 is formed with four holding holes 410. The holding holes 410 are formed at four positions corresponding to the respective holding holes 346 of the magnetic core 310A. Each of the holding holes 410 pierces the radiating member 400 in the up-down direction.

Each of the coupling members 500 is made of a thermal conductor to have a cylindrical shape. The coupling member 500 is held by the holding hole 410 of the radiating member 400 and the holding hole 346 of the magnetic core 310A. Similar to the magnetic core 310 (see FIG. 6), the magnetic core 310A has proper elasticity. Accordingly, when a diameter of the coupling member 500 is slightly larger than a diameter of the holding hole 346, the coupling member 500 can be securely held by the magnetic core 310A without using an adhesive. The coupling member 500 may be fit in and held by the holding hole 410 of the radiating member 400. The coupling member 500 may be integrally formed with the radiating member 400.

Each of the coupling members 500 extends downward from the radiating member 400 to be connected to the facing surface 220 of the circuit board 200. In other words, the coupling members 500 couple the circuit board 200 with the radiating member 400 via the magnetic core 310A.

The coating 600 according to the present embodiment is made of a thin resin. The radiating surface 330 of the magnetic core 310 has a central portion which is not in contact with the radiating member 400. The coating 600 coats the central portion of the radiating surface 330. Since the radiating surface 330 is thus coated with the coating 600, the first coupling portions 364 of the coil 350 can be guarded while exposed on the radiating surface 330. Moreover, when the coating 600 is formed to have a proper thickness, the heat radiation from the radiating surface 330 is not largely blocked. As can be seen from the above explanation, the radiating surface 330 according to the present embodiment is radiatable heat outward of the module 10A. However, if the module 10A is required to more efficiently radiate the heat, the radiating surface 330 may not be coated with the coating 600.

According to the present embodiment, the heat generated by the circuit board 200 and the inductor 300A can be conducted to the radiating member 400 to be radiated from the radiating member 400. Thus, the module 10A according to the present embodiment has a heat radiation path extending through the coupling member 500 in addition to the heat radiation path extending through the connection portions 370 of the coil 350. Accordingly, the module 10A can be cooled more efficiently.

Similar to the first embodiment, the outer circumference of the inductor 300A or the outer circumference of the module 10A may be covered by a resin or a metal. Moreover, the radiating surface 330 may be in contact, at least in part, with a cooling member outside of the module 10A, for example, a heat sink. Moreover, the radiating member 400 may be in contact, at least in part, with a cooling member outside of the module 10A. As previously described, even when the magnetic core 310A receives the pressing force, the magnetic core 310A is hardly to be damaged, and the magnetic characteristics of the magnetic core 310A are hardly to be degraded. Accordingly, the outside cooling member can be closely attached to the radiating member 400 by a high pressing force. The thus-configured module 10A can be cooled more efficiently.

Third Embodiment

Figure 12:
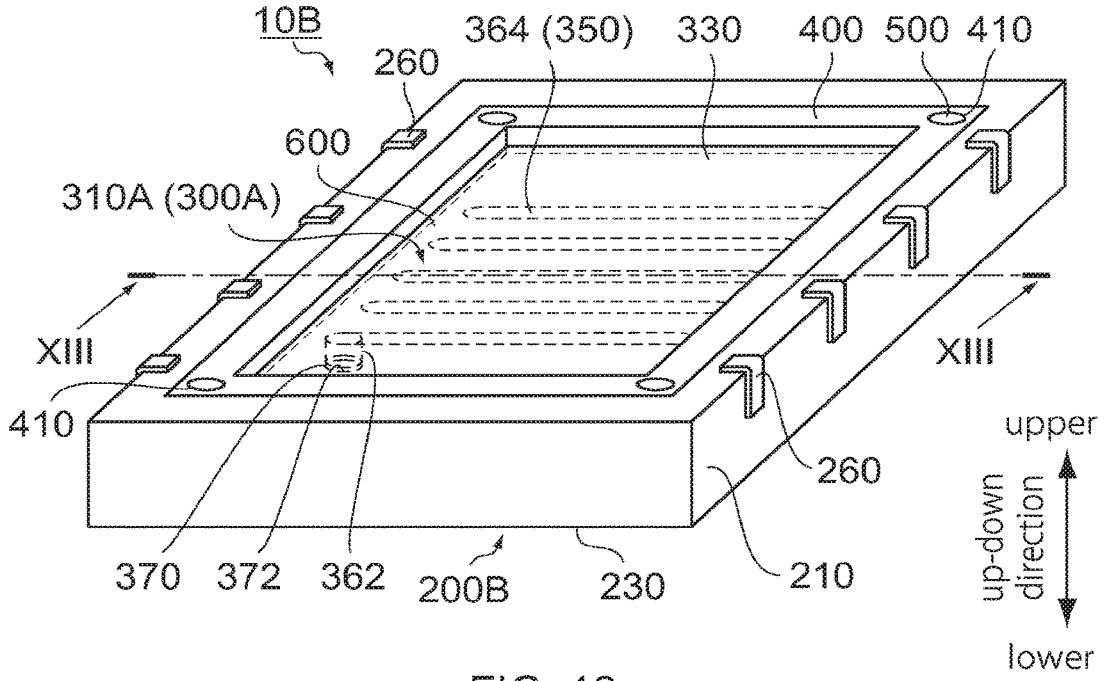
FIG. 12 is a perspective view schematically showing a module according to a third embodiment of the present invention, wherein the hidden first coupling portions, one of the hidden piercing portions and one of the hidden connection portions of the coil are illustrated by dotted line.

As can be seen from FIGS. 10 and 12, a module (power module) 10B according to a third embodiment of the present invention is a modification of the module 10A (see FIG. 10). The module 10B comprises a circuit board 200B which is slightly different from the circuit board 200. Moreover, the module 10B comprises the inductor 300A, the radiating member 400, the coupling members 500 and the coating 600 which are same as those of the module 10A. Hereafter, explanation is mainly made about different points between the module 10B and the module 10A.

Figure 13:
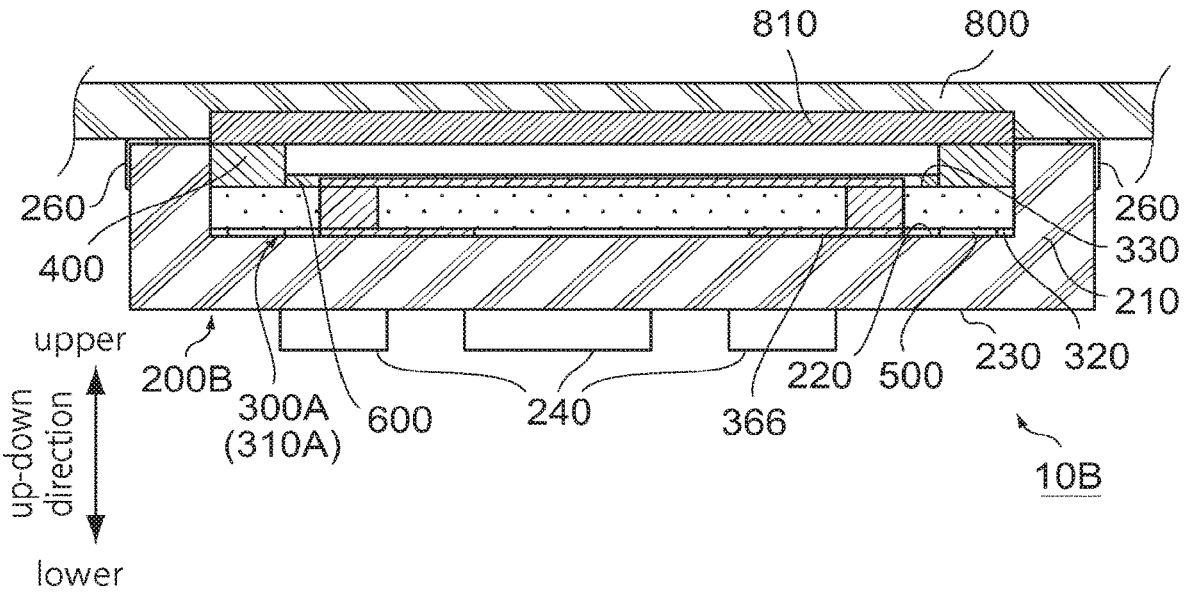
FIG. 13 is a cross-sectional view showing the module of FIG. 12, taken along line XIII-XIII.

As can be seen from FIGS. 12 and 13, the circuit board 200B has a box-like shape. In detail, the circuit board 200B has four sidewalls 210. The sidewalls 210 extend upward from four sides of the facing surface 220, respectively. For example, the thus-configured circuit board 200B can be formed of a plurality of circuits boards each having a plate-like shape. According to the present embodiment, any electronic component 240 is not mounted on the facing surface 220 of the circuit board 200B, while various electronic components 240 are mounted on the rear surface 230 of the circuit board 200B.

The inductor 300A and the radiating member 400 are accommodated in a space surrounded by the facing surface 220 and the sidewalls 210. The second coupling portions 366 of the coil 350 are arranged to be in contact with or close to the facing surface 220. Accordingly, the connection portion 370 of the coil 350 extends short (see FIG. 12).

As shown in FIGS. 12 and 13, the sidewalls 210 are provided with a plurality of (according to the present embodiment, eight) terminals 260. Each of the terminals 260 is connected to the electronic component 240 via the signal line (not shown). The terminal 260 is to be electrically connected to an apparatus (not shown) outside of the module 10B, for example, for input/output of electric current, for monitor of output voltage and for control of switching frequency.

As shown in FIG. 13, the module 10B configured as described above can be connected to an outer circuit board 800. The outer circuit board 800 according to the present embodiment is provided with a cooling member 810 which has high thermal conductivity. For example, the cooling member 810 can be formed of a metal. The cooling member 810 is arranged at a position corresponding to the radiating member 400 of the module 10B. When the terminals 260 are connected to the outer circuit board 800, the radiating member 400 is closely attached to the cooling member 810. Accordingly, the heat generated by the module 10B can be efficiently radiated to the cooling member 810 from the radiating member 400. The radiating member 400 may be fixed to the cooling member 810, for example, by soldering. In this case, the module 10B can be cooled more efficiently.

Fourth Embodiment

Figure 14:
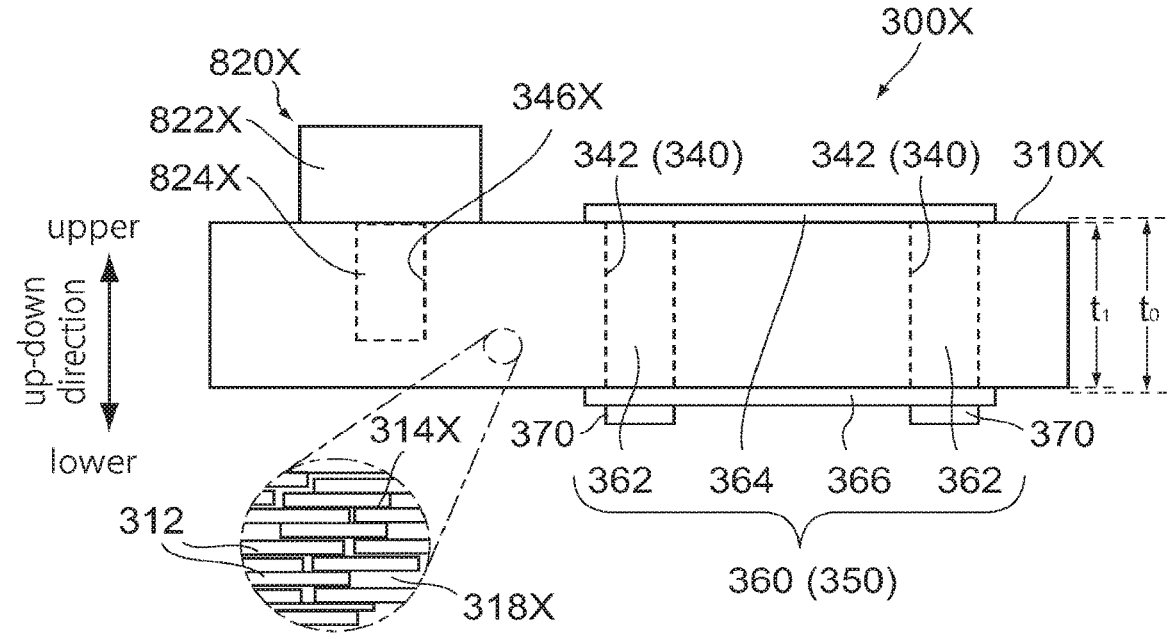
FIG. 14 is a side view schematically showing an inductor according to a fourth embodiment of the present invention, wherein hidden parts of the coil and a hidden part of a spacer of the inductor are illustrated by dotted line, and wherein components of a magnetic core of the inductor is schematically illustrated in a circle drawn by chain dotted line.

As can be seen from FIGS. 5 and 14, an inductor 300X and a magnetic core 310X according to a fourth embodiment of the present invention are modifications of the inductor 300 and the magnetic core 310 according to the first embodiment. The inductor 300X and the magnetic core 310X have structure and function similar to those of the inductor 300 and the magnetic core 310. Hereafter, explanation is made about the inductor 300X and the magnetic core 310X in more detail than that of the first embodiment.

As shown in FIG. 14, the inductor 300X according to the present embodiment comprises the magnetic core 310X, the coil 350 and a spacer 820X. The coil 350 according to the present embodiment is substantially same as the coil 350 according to the first embodiment. In detail, the coil 350 is made of a metal, for example, a copper. The coil 350 does not have an insulating coating. However, the coil 350 may have an insulating coating. The coil 350 has a coil portion 360 and a connection portion 370.

Similar to the first embodiment, the magnetic core 310X according to the present embodiment is a dust core which is formed by binding particles of the soft magnetic metal powder 312 by a binder component 314X. The magnetic core 310X has a plate-like shape perpendicular to the up-down direction. The plate-like shape of magnetic core 310X has a thickness of 1 mm or less.

Similar to the first embodiment, the soft magnetic metal powder 312 having flat-like shape is formed, for example, by flattening a granular soft magnetic metal powder (material powder) by using a ball-mill. It is preferable that the material powder (the soft magnetic metal powder 312) be made of an Fe based alloy so as to have necessary magnetic characteristics. Moreover, it is preferable that the soft magnetic metal powder 312 be made of an Fe—Si based alloy. Moreover, it is preferable that the soft magnetic metal powder 312 be made of an Fe—Si—Al based alloy (sendust) or an Fe—Si—Cr based alloy. When the soft magnetic metal powder 312 includes Si and Al, the ratio of Si relative to the whole soft magnetic metal powder 312 is preferred to be between 3 wt % and 18 wt %, both inclusive, and the ratio of Al relative to the whole soft magnetic metal powder 312 is preferred to be between 1 wt % and 12 wt %, both inclusive. When the soft magnetic metal powder 312 includes Si and Al of the aforementioned ratios, each of magnetocrystalline anisotropy constant and magnetostriction constant of the magnetic core 310X is lowered, while the magnetic characteristics of magnetic core 310X is improved. Moreover, when the magnetic core 310X is formed, surfaces of the particles of the soft magnetic metal powder 312 are formed with passive film. Accordingly, electric resistivity of the magnetic core 310X is improved.

The binder component 314X, which binds the particles of the soft magnetic metal powder 312 having flat-like-shape, includes a silicon oxide as a principal component. This binder component 314X can be formed of the binder 314 including Si. In detail, similar to the first embodiment, the soft magnetic metal powder 312 is mixed with a solvent, a viscosity improver and the binder 314 to form slurry. For example, a methyl phenyl silicone resin, which includes organic component and solid content, may be used as the binder 314. The slurry is applied and heated so that the solvent is volatilized. The thus-treated slurry forms a preliminarily body, which is a component of the magnetic core 310X. Because the thus-formed preliminarily body is not formed of a brittle material such as a ferrite, the preliminarily body can be pressure-molded. A predetermined number of the preliminarily bodies is compressed by pressure to form a pressed body. When the pressed body is exposed to heat-treatment at high temperature, for example, at 600° C., the magnetic core 310X is obtained.

When the preliminarily bodies are compressed by the pressure, structural distortion might occur. Generally, the structural distortion might lower relative permeability. However, according to the present embodiment, even if the relative permeability is temporally lowered, the relative permeability is recovered to have high value by the aforementioned heat-treatment at high temperature.

The organic component of the methyl phenyl silicone resin is decomposed by the aforementioned heat-treatment at high temperature. Meanwhile, the solid content of the methyl phenyl silicone resin becomes the binder component 314X, which is made of a glass material including a silicon oxide as a principal component, while binding the particles of the soft magnetic metal powder 312. Because the soft magnetic metal powder 312 is thus bound by inorganic substances, or the binder component 314X, the thus-formed magnetic core 310X is resistible even against reflow soldering under high temperature about 260° C. Moreover, because the soft magnetic metal powder 312 is bound by insulator, the magnetic core 310X has superior frequency characteristics and high electric resistivity of 10 KΩ·cm or more. Since the magnetic core 310X according to the present embodiment has the high electric resistivity, similar to the magnetic core 310 (see FIG. 5), the coil portion 360 made of conductor can be directly brought into contact with the magnetic core 310X.

The organic component of the binder 314 is lost by the aforementioned heat-treatment at high temperature. In other words, the binder 314 loses a part of its weight and volume by the heat-treatment. Accordingly, the magnetic core 310X is formed with void, or vacancy 318X therewithin. Thus, the magnetic core 310X includes the soft magnetic metal powder 312, the binder component 314X and the vacancy 318X.

Under the aforementioned heat-treatment at high temperature, because different parts of the pressed body have different temperatures from one another, the different parts of the pressed body thermally expand at different rates. Moreover, the binder 314 shrinks and decomposes at different rates in the different parts. Accordingly, an internal stress is caused under the aforementioned heat-treatment at high temperature. When the pressed body has a large thickness, the internal stress might be so large that the pressed body is formed with a crack or a separation. Moreover, under the aforementioned heat-treatment at high temperature, the pressed body is formed with a gas therewithin as a result of the decomposition of the binder 314. When the pressed body has a large thickness, the gas formed in a deep part of the pressed body is hardly diffused outward. Accordingly, the gas pressure inside the pressed body might be heightened so that the pressed body might be formed with a crack or a separation. On the other hand, when the pressed body has a thickness of 1 mm or less, the crack and the separation are not formed even under the aforementioned heat-treatment at high temperature. Accordingly, it is desirable that the pressed body have a thickness of 1 mm or less. It is more desirable that the pressed body has a thickness of 0.7 mm or less.

In order to improve the magnetic characteristics, it is desirable that the magnetic core 310X include the soft magnetic metal powder 312 of 60 vol % or more. In this condition, the magnetic core 310X has a high saturation magnetic flux density and high permeability similar to that of ferrite. Specifically, the magnetic core 310X having a saturation magnetic flux density of 0.5 T or more can be obtained. Since the magnetic core 310X according to the present embodiment is hardly magnetically saturated, the magnetic core 310X can have a reduced size. Moreover, the magnetic core 310X, which has relative permeability having a real number component of 50 or more at frequency of 1 MHz, can be obtained. Moreover, the magnetic core 310X, which has relative permeability having a real number component of 100 or more at frequency of 1 MHz, can be obtained. In detail, according to the present embodiment, the real number component of the relative permeability in Initial permeability range becomes the maximum value (Y) by magnetic resonance at a predetermined frequency (X MHz) of 1 MHz or more. This predetermined frequency (X MHz) and the maximum value (Y) meet the condition of $X \times Y \geq 300$. Accordingly, it is possible to prevent increase of eddy current loss, increase of core loss and degrade of noise absorption performance.

Figure 15:
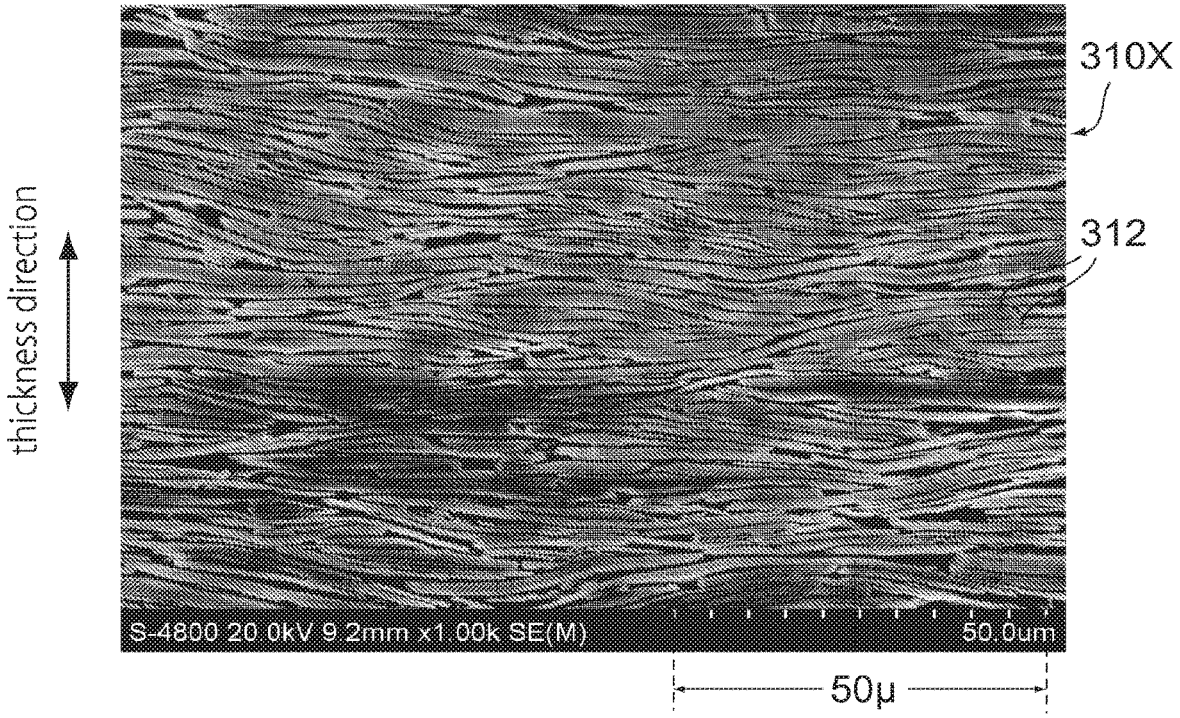
FIG. 15 is a copy of an image showing a part of a cross-section of the magnetic core according to the fourth embodiment of the present invention.

As shown in FIG. 15, the particles of the soft magnetic metal powder 312 of the magnetic core 310X are arranged to be roughly perpendicular to a thickness direction, or the up-down direction. In other words, the particles of the soft magnetic metal powder 312 are arranged to be roughly in parallel to a predetermined plane, or the horizontal plane. Accordingly, the magnetic core 310X has low demagnetization factor in a direction parallel to the predetermined plane to have the aforementioned improved relative permeability. Thus, the magnetic core 310X has an axis of easy magnetization extending in parallel to the predetermined plane. In order to further improve the relative permeability in a direction parallel to the predetermined plane, it is preferable that the soft magnetic metal powder 312 have average aspect ratio of 10 or more.

Moreover, the particles of the soft magnetic metal powder 312 stack on one another in the thickness direction while shifted from one another in a direction parallel to the predetermined plane. Accordingly, even when the magnetic core 310X is formed with a crack, the crack can be prevented from proceeding. According to the present embodiment, the magnetic core 310X can have not only a thickness of 1 mm or less, or a thickness of 0.5 mm or less, but also have high toughness in comparison with a ceramic material, or a ferrite.

Referring to FIG. 14, it is desirable that the magnetic core 310X include the vacancy 318X between 10 vol % and 25 vol %, both inclusive. In other words, it is preferable that the magnetic core 310X include the vacancy 318X having a volume ratio, or porosity between 10 vol % and 25 vol %, both inclusive. The desirable porosity can be obtained by adjusting an addition amount of the binder 314 upon forming of the slurry or by adjusting the pressure upon compressing the preliminarily bodies. When the porosity is 10 vol % or more, the magnetic core 310X has elasticity so that the magnetic core 310X can be easily processed variously. When the porosity is 25 vol % or less, the magnetic core 310X can include a sufficient amount of the soft magnetic metal powder 312.

It is preferable that the magnetic core 310X include the binder component 314X having a volume filling ratio (volume ratio) between 10 vol % and 30 vol %, both inclusive. When the volume ratio of the binder component 314X is less than 10 vol %, the magnetic core 310X has insufficient strength. When the volume ratio of the binder component 314X is more than 30 vol %, the magnetic core 310X cannot have the soft magnetic metal powder 312 of 60 vol % or more, and the porosity of 10 vol % or more.

In short, the magnetic core 310X according to the present embodiment includes the soft magnetic metal powder 312 of 60 vol % or more, the binder component 314X between 10 vol % and 30 vol %, both inclusive, and the vacancy 318X between 10 vol % and 25 vol %, both inclusive. The magnetic core 310X has rubber hardness degree between 92 and 96, both inclusive, in accordance with ISO 7619 Type D. Thus, the magnetic core 310X is elastically deformable.

Since the magnetic core 310X is an elastic body, its Young's modulus can be measured as described below. At first, the plate-like magnetic core 310X having a width (w) and a thickness (t) is prepared. Then, two supported portions of the magnetic core 310X are supported from below. The supported portions are apart from each other by a distance (L) in a longitudinal direction of the magnetic core 310X. Then, a pressed portion, which is located between the supported portions in the longitudinal direction, is pressed by a load (P) from above. Then, a tensile strain (δ) generated by the load (P) is measured. As is well-known, the Young's modulus can be calculated from the aforementioned width (w), the thickness (t), the distance (L), the load (P) and the tensile strain (δ). According to the present embodiment, the magnetic core 310X, which has the Young's modulus between 10 GPa and 90 GPa, both inclusive, can be obtained. Moreover, the magnetic core 310X, which has the Young's modulus between 20 GPa and 50 GPa, both inclusive, can be obtained by mainly adjusting the porosity of magnetic core 310X.

As can be seen from FIG. 14, the magnetic core 310X configured as described above can be processed variously. For example, the magnetic core 310X according to the present embodiment is formed with a plurality of the through holes 340. Similar to the first embodiment (see FIG. 5), the coil portion 360 of the coil 350 has a plurality of the piercing portions (via conductors) 362, one or more of the first coupling portions (coupling conductors) 364 and one or more of the second coupling portions (coupling conductors) 366. The piercing portions 362 of the coil portion 360 pierce the through holes 340 in the up-down direction, respectively. In detail, the piercing portion 362 pierces the through hole 340 while elastically deforming the inner wall 342 of the through hole 340. The coil 350 is held by the pressing force which is applied to the piercing portion 362 from the inner wall 342 of the through hole 340. Thus, according to the present embodiment, similar to the first embodiment, the piercing portion 362 inserted in the through hole 340 has sufficient pulling yield strength without adhered.

In detail, since the magnetic core 310X includes the vacancy 318X of proper vol %, portion (press-fit portion) about the inner wall 342 is properly compressed and deformed so that stress generated at the press-fit portion does not affect the whole magnetic core 310X. Accordingly, the magnetic core 310X is prevented from being deformed to be damaged.

Similar to the first embodiment (see FIG. 5), each of the first coupling portion 364 and the second coupling portion 366 is attached to the magnetic core 310X. The first coupling portion 364 couples ends of the two piercing portions 362 with each other at an upper surface of the magnetic core 310X. The second coupling portion 366 couples ends of the two piercing portions 362 with each other at a lower surface of the magnetic core 310X. The first coupling portion 364 and the second coupling portion 366 can be securely fixed to the piercing portions 362 by various methods such as electric resistance welding and ultrasonic welding to be attached to the magnetic core 310X.

When the first coupling portion 364 and the second coupling portion 366 are attached to the magnetic core 310X, the magnetic core 310X is sandwiched between the first coupling portion 364 and the second coupling portion 366 to be compressed as a whole in the up-down direction. Accordingly, a thickness (t1) of the magnetic core 310X after the attachment of the first coupling portion 364 and the second coupling portion 366 to the magnetic core 310X decreases between 2.5% and 5.0%, both inclusive, relative to another thickness (t0) of the magnetic core 310X before the attachment of the first coupling portion 364 and the second coupling portion 366 to the magnetic core 310X. If the coil portion 360 is detached from the magnetic core 310X, the thickness (t1) of the magnetic core 310X after the attachment is restored toward the thickness (t0) of the magnetic core 310X before the attachment. In other words, the decreased thickness of the magnetic core 310X, which is about between 2.5% and 5.0% of the thickness (t0), is almost restored.

As can be seen from the above explanation, the magnetic core 310X according to the present embodiment has such a property that the magnetic core 310X is easily compressed to have a predetermined thickness while easily restored to its initial state from the compressed state. The magnetic core 310X has the aforementioned property not only because of the vacancy 318X included in the magnetic core 310X, but also because of elasticity of the soft magnetic metal powder 312. Since the magnetic core 310X has the aforementioned property, an elastic force of the magnetic core 310X in the thickness direction (up-down direction) presses the upper surface and the lower surface of the magnetic core 310X against the first coupling portion 364 and the second coupling portion 366, respectively. Accordingly, even if the magnetic core 310X has a gap formed between the piercing portion 362 of the coil 350 and the inner wall 342 of the through hole 340, the magnetic core 310X can hold and fix the first coupling portion 364 and the second coupling portion 366.

The magnetic core 310X configured as described above can securely hold not only the coil portion 360 but also various members. This processability of the magnetic core 310X is similar to the processability of wood which can be nailed. This processability makes the processing of the magnetic core 310X dramatically easy and improves the reliability of the processing.

For example, as shown in FIG. 14, the magnetic core 310X according to the present embodiment is formed with a holding hole 346X. The spacer 820X has a body portion 822X and a held portion 824X. In the horizontal plane perpendicular to the up-down direction, the body portion 822X is rather larger than the holding hole 346X while the held portion 824X is slightly larger than the holding hole 346X. Similar to the piercing portion 362, the thus-configured held portion 824X can be press-fit into and held by the holding hole 346X. When the held portion 824X is press-fit into the holding hole 346X, a lower surface of the body portion 822X is brought into contact with the upper surface of the magnetic core 310X. Since the body portion 822X has a large size in the horizontal plane, the body portion 822X prevents dust, which is produced upon the press-fit of the held portion 824X, from falling off.

Similar to the first embodiment, the inductor 300X and the magnetic core 310X according to the present embodiment can be variously modified. For example, the size of the piercing portion 362 in the horizontal plane may be smaller than the size of the through hole 340. In other words, the piercing portion 362 may not press-fit into the through hole 340 but pass through the inside of the through hole 340 without being held by the inner wall 342. In this case, the piercing portion 362 may be fixed to the through hole 340, for example, by an adhesive. Moreover, each of the first coupling portion 364 and the second coupling portion 366 may be joined to the piercing portion 362 by pressure or by soldering. Moreover, portions of the magnetic core 310X, which are to be in contact with the first coupling portion 364 and the second coupling portion 366, respectively, may be formed with recesses corresponding to the first coupling portion 364 and the second coupling portion 366, respectively. When the recesses are formed, each of the first coupling portion 364 and the second coupling portion 366 is more securely held by the magnetic core 310X.

Moreover, the surface of the magnetic core 310X may be wholly or partially covered by an insulating resin. For example, an acrylic resin or a polyolefin resin may be used as the insulating resin. The thus-covered surface of the magnetic core 310X has more improved insulation. In addition, even when the magnetic core 310X is formed with a crack, the crack can be more securely prevented from proceeding. A part of the insulating resin impregnates an outer layer of the magnetic core 310X. Accordingly, the forming and the proceeding of the crack can be more securely prevented.

Moreover, a magnetic core may comprise a plurality of magnetic core components each of which functions as the magnetic core 310X according to the present embodiment. More specifically, a plurality of the magnetic core components, for example, a plurality of the magnetic cores 310X may be stacked on one another via an adhesive to form a single laminated magnetic core. As previously described, the magnetic core 310X according to the present embodiment has a structure which is hardly formed with a crack. The crack can be prevented from being formed even when the stacked magnetic core components (magnetic cores 310X) are pressed against and bonded to one another. Accordingly, the laminated magnetic core having a thickness more that 1 mm can be obtained. In order to obtain the laminated magnetic core while preventing the crack, it is sufficient that each of the stacked magnetic cores 310X has a thickness of 1 mm or less. However, it is preferable that each of the stacked magnetic cores 310X have a thickness of 0.5 mm or less.

Generally, a ferrite, which is a ceramic material, has high relative permeability of 50 or more, or 100 or more at frequency in MHz range. Moreover, a ferrite has sufficient stiffness without a reinforcing member or the like. A ferrite is therefore generally used as a material of a magnetic core. However, since a ferrite is a brittle material, it is difficult to form a magnetic core by using a simple, precise and reliable joint method such as an indenting, a placing, a press-fit or a forcible press-fit.

On the other hand, since the magnetic core according to the present invention is formed of the soft magnetic metal powder having flat-like shape, a crack or a break formed in the magnetic core does not proceed in the thickness direction even when the magnetic core is thin. Accordingly, the magnetic core according to the present invention has toughness higher than the magnetic core formed of a ferrite. Moreover, when the volume ratio of the vacancy formed within the magnetic core is in a predetermined range, the magnetic core has elasticity. Accordingly, the magnetic core can be easily processed. For example, the magnetic core can be formed with a hole. Moreover, when some member is press-fit into the hole formed in the magnetic core, portion around the hole of the magnetic core is elastically deformed so that the stress generated by the press-fit does not affect the whole magnetic core. Accordingly, the magnetic core is prevented from being deformed to be damaged. As can be seen from the aforementioned explanation, when the inductor comprises the magnetic core according to the present invention, the flexibility of design of the inductor is dramatically improved so that the inductor having reduced size and high reliability can be formed.

Moreover, the present invention is applicable to a magnetic component other than the magnetic core and the inductor.

EXAMPLES

Hereafter, explanation is made in further detail about a magnetic core and an inductor according to the present invention with reference to specific examples.

First, explanation is made in detail about porosity of void or vacancy formed in a magnetic core according to the present invention with reference to Samples 1 and 2.

Forming of a Preliminarily Body of Sample 1

A soft magnetic metal powder was used as a material of a preliminarily body of Sample 1. In detail, a water-atomized powder made of an Fe—Si—Cr based alloy was used. The powder included Si of 3.5 wt % and Cr of 2 wt %. The powder had an average grain diameter (D50) of 33 μm. The powder was flatten by using a ball-mill. In detail, after the powder was processed by 8 hours forging, the powder was exposed to 3 hours heat-treatment at 800° C. under a nitrogen atmosphere so that a flat powder, or an Fe—Si—Cr based powder having flat-like shape was obtained. Then, the flat powder was mixed with a solvent, a viscosity improver and a thermoset binder component to form slurry. An ethanol was used as the solvent. A polyacrylic acid ester was used as the viscosity improver. A methyl phenyl silicone resin was used as the thermoset binder component. The addition amount of the polyacrylic acid ester was 3 wt % relative to the flat powder, and the addition amount of the solid content of the methyl phenyl silicone resin was 4 wt % relative to the flat powder. The slurry was applied on a polyethylene-telephthalate (PET) film by using a slot die. Then, the solvent was volatilized by one hour drying at a temperature of 60° C. so that a preliminarily body was formed.

Forming of Flat Plates of Sample 1

The preliminarily body was cut into a plurality of square shapes each having a width of 30 mm and a length of 30 mm by using a trimming die so that a plurality of sheets was formed. A predetermined number of the sheets was stacked and inserted into a metal die. The sheets in the metal die were pressure-molded one hour-long by forming pressure of 2 MPa at 150° C. so that a pressed body is obtained. In detail, the eleven pressed bodies having various thicknesses were formed by changing the stacked number, or the predetermined number of the sheets. For example, the pressed body having a thickness of 1 mm was formed of the approximately thirty sheets. The pressed bodies were exposed to two hours heat-treatment at 600° C. under an atmosphere so that eleven fat plates were formed. The viscosity improver was almost completely decomposed by this heat-treatment not to remain in the flat plate. Moreover, by this heat-treatment, the solid content of the methyl phenyl silicone resin lost a part of its weight while changed into a heat-treated binder component, or a binder component made of a glass material including a silicon oxide as a principal component. For example, the heating loss of the solid content of the methyl phenyl silicone resin was 20 wt % when heat-treated one hour at 550° C. under an atmosphere.

Measurement of Porosity of the Flat Plates of Sample 1 and Checking of Rate of Crack Incidence of the Flat Plates of Sample 1

A forming density of each of the thus-formed flat plates was measured by the Archimedes method. Specifically, a real density of the flat powder was pre-calculated to be 7.6 g/cm$^3$, and a density of the hardened methyl phenyl silicone resin (binder component) was pre-calculated to be 1.3 g/cm$^3$. A volume filling ratio (volume ratio) of the metal component (flat powder), a volume filling ratio (volume ratio) of the heat-treated binder component (binder component) and porosity of the vacancy in the flat plate were calculated by using the aforementioned numeric values. A rate of crack incidence was also checked by visually watching four side surfaces of the flat plate.

The result of the aforementioned measurement and the checking is shown in Table 1.

TABLE 1

| Thickness of Flat Plate (mm) | Volume Filling Ratio (vol %) Metal Component | Volume Filling Ratio (vol %) Binder Component | Porosity (vol %) | Rate of Crack Incidence |
|---|---|---|---|---|
| 0.4 | 65 ± 1 | 15 ± 1 | 20 ± 1 | 0/10 |
| 0.5 | | | | |
| 0.6 | | | | |
| 0.7 | | | | |
| 0.8 | | | | |
| 1.0 | | | | |
| 1.2 | | | | 3/10 |
| 1.4 | | | | 8/10 |
| 1.6 | | | | 10/10 |
| 1.8 | | | | 10/10 |
| 2.0 | | | | 10/10 |

The crack in any flat plate was so fine that the flat plate could be prevented from being cracked, for example, by coating its side surfaces with a resin. Moreover, when a thickness of the flat plate was 1.0 mm or less, the crack was hardly formed so that the aforementioned prevention was unnecessary.

Forming of a Preliminarily Body of Sample 2

A soft magnetic metal powder was used as a material of a preliminarily body of Sample 2. In detail, a water-atomized powder made of an Fe—Si—Cr based alloy was used. The powder included Si of 3.5 wt % and Cr of 2 wt %. The powder had an average grain diameter (D50) of 33 μm. The powder was flatten by using a ball-mill. In detail, after the powder was processed by 8 hours forging, the powder was exposed to 3 hours heat-treatment at 800° C. under a nitrogen atmosphere so that a flat powder, or an Fe—Si—Cr based powder having flat-like shape was obtained. Then, the flat powder was mixed with a solvent, a viscosity improver and a thermoset binder component to form slurry. An ethanol was used as the solvent. A polyacrylic acid ester was used as the viscosity improver. A methyl phenyl silicone resin was used as the thermoset binder component. The addition amount of the solid content of the methyl phenyl silicone resin was varied between 2 wt % and 20 wt % relative to the flat powder so that eleven types of the slurry were formed. The slurry was applied on a PET film by using a slot die. Then, the solvent was volatilized by one hour drying at a temperature of 60° C. so that a preliminarily body was formed. By the aforementioned forming process, eleven types of the preliminarily bodies containing different amounts of the methyl phenyl silicone resin were formed.

Forming of Flat Plates of Sample 2

Each of the preliminarily bodies was cut into a plurality of square shapes each having a width of 30 mm and a length of 30 mm by using a trimming die so that a plurality of sheets was formed. Thus, eleven types of the sheets containing different amounts of the methyl phenyl silicone resin were formed, wherein each type includes a plurality of the sheets containing the same amount of the methyl phenyl silicone resin. A predetermined number of the sheets of each type was stacked and inserted into a metal die. The sheets in the metal die were pressure-molded one hour-long by forming pressure of 2 MPa at 150° C. so that a pressed body is obtained. Thus, eleven types of the pressed bodies containing different amounts of the methyl phenyl silicone resin were formed, wherein each type including the fifteen pressed bodies containing the same amount of the methyl phenyl silicone resin. The pressed bodies were exposed to one hour heat-treatment at 550° C. under a nitrogen atmosphere so that eleven types of fat plates were formed. The amounts of the methyl phenyl silicone resin of the eleven types were different from each other. Each of the eleven types included the fifteen fat plates which contained the same amount of the methyl phenyl silicone resin. Each of the flat plates had a thickness of 0.7 mm. The viscosity improver was almost completely decomposed by this heat-treatment not to remain in the flat plate. Moreover, by this heat-treatment, the solid content of the methyl phenyl silicone resin lost a part of its weight while changed into a heat-treated binder component, or a binder component made of a glass material including a silicon oxide as a principal component. For example, the heating loss of the solid content of the methyl phenyl silicone resin was 20 wt % when heat-treated one hour at 550° C. under an atmosphere.

Measurement of Porosity of the Flat Plates of Sample 2

A forming density of each of the thus-formed flat plates was measured by the Archimedes method. Specifically, a real density of the flat powder was pre-calculated to be 7.6 g/cm$^3$, and a density of the hardened methyl phenyl silicone resin (binder component) was pre-calculated to be 1.3 g/cm$^3$. A volume filling ratio (volume ratio) of the metal component (flat powder), a volume filling ratio (volume ratio) of the heat-treated binder component (binder component) and porosity of the vacancy in the flat plate were calculated by using the aforementioned numeric values.

Forming of Stacked Bodies of Sample 2

Five stacked bodies per each of eleven types were formed of the fifteen flat plates per each of eleven types. In other words, each of the stacked bodies was formed of the three flat plates containing the same amount of the methyl phenyl silicone resin. In detail, the three flat plates were stacked on one another via an adhesive. An one-pack epoxy resin, namely, S-71 of RESINOUS KASEI CO., Ltd., was used as the adhesive. The stacked flat plates were mirror-polished. Then, the stacked flat plates were sandwiched between two stainless boards each having a thickness of 10 mm. The stacked flat plates were pressed via the stainless boards. In detail, the stacked flat plates were pressed with a pressure of 15 MPa for three hours at 170° C. by using a hydraulic press machine so that the stacked flat plates were bonded to one another to become a single stacked body. By the aforementioned forming process, the five stacked bodies were formed of the fifteen flat plates of each type.

Checking of Rate of Crack Incidence of the Stacked Bodies of Sample 2

After the stacked flat plates were completely bonded, a rate of crack incidence was checked by visually watching four side surfaces of the stacked body.

The result of the aforementioned measurement and the checking is shown in Table 2.

TABLE 2

| Addition Amount of Methyl Phenyl Silicone Resin (wt %) | Volume Filling Ratio (vol %) Metal Component | Binder Component | Porosity (vol %) | Rate of Crack Incidence |
|---|---|---|---|---|
| 2 | 60 | 7 | 33 | 3/5 |
| 2.5 | 65 | 9.5 | 25.5 | 0/5 |
| 3 | 70 | 12 | 18 | |
| 4 | 68 | 16 | 16 | |
| 5 | 65 | 19 | 16 | |
| 6 | 62 | 22 | 16 | |
| 8 | 59 | 27.5 | 13.5 | |
| 10 | 55 | 32 | 13 | |
| 12 | 53 | 37 | 10 | |
| 14 | 52 | 42.5 | 5.5 | 1/5 |
| 16 | 49 | 46.5 | 4 | 2/5 |

As shown in Table 2, when the volume filling ratio of the binder component was 7 vol % and the porosity was 33 vol %, the stacked body had insufficient strength to be formed with a separation. Moreover, when the porosity was 10 vol % or less, the stacked body was formed with a crack. When the porosity was 10 vol % or less, the stacked body did not sufficiently include the vacancy therewithin so that the stacked body could not be compressively deformed almost at all. Accordingly, when a shearing stress was generated within the stacked body upon the bonding with the pressure, the stacked body could not sufficiently absorb the shearing stress by the compressive deformation. The crack was supposed to be formed as a result. On the other hand, when the volume filling ratio of the binder component was between 9.5 vol % and 37 vol %, both inclusive, and the porosity was between 10 vol % and 25.5 vol %, both inclusive, the stacked body was formed with no crack. In this case, the stacked body included a proper amount of the binder component to have sufficient strength. Moreover, the stacked body had proper porosity. Accordingly, the shearing stress, which was generated within the stacked body upon the bonding with the pressure, was supposed to be absorbed by the compressive deformation of the stacked body. Thus, when the porosity of the stacked body was controlled to be between 10 vol % and 25.5 vol %, both inclusive, the vacancy within the stacked body allowed the compressive deformation to prevent the stacked body from being formed with the crack.

Next, explanation is made about a magnetic core and an inductor of each of Example 1 and Comparative Examples 1 to 3.

Forming of a Preliminarily Body of the Magnetic Core of Example 1

A soft magnetic metal powder was used as a material of a preliminarily body of Example 1. In detail, a gas-atomized powder made of an Fe—Si—Al based alloy (sendust) was used. The powder had an average grain diameter (D50) of 55 μm. The powder was flatten by using a ball-mill. In detail, after the powder was processed by 8 hours forging, the powder was exposed to 3 hours heat-treatment at 700° C. under a nitrogen atmosphere so that a flat powder, or a sendust powder having flat-like shape was obtained. Then, the flat powder was mixed with a solvent, a viscosity improver and a thermoset binder component to form slurry. An ethanol was used as the solvent. A polyvinyl butyral was used as the viscosity improver. A methyl phenyl silicone resin was used as the thermoset binder component. The slurry was applied on a PET film by using a slot die. Then, the solvent was volatilized by one hour drying at a temperature of 60° C. so that a preliminarily body was formed.

Forming of a Flat Plate for Measuring Characteristics of the Magnetic Core of Example 1

The preliminarily body was cut into a plurality of square shapes each having a width of 30 mm and a length of 30 mm by using a trimming die so that a plurality of sheets was formed. A predetermined number of the sheets was stacked and inserted into a metal die. The sheets in the metal die were pressure-molded one hour-long by forming pressure of 200 MPa at 150° C. so that a pressed body is obtained. The pressed body had a thickness of 0.25 mm. The pressed body was exposed to one hour heat-treatment at 600° C. under a nitrogen atmosphere so that a fat plate was formed.

Characteristics of the Flat Plate of Example 1

The thus-formed flat plate had a density of 4.9 g/cm$^3$ and volume resistivity (electric resistivity) of 10 KΩ·cm or more. A volume filling ratio (volume ratio) of the metal component (flat powder) in the flat plate was calculated by using the density of the flat plate. The volume filling ratio of the metal component was about 67 vol %. The flat plate was sandwiched between two glass epoxy boards each made of a Flame Retardant Type 4 (FR4). Each of the glass epoxy boards had a thickness of 1.5 mm, a width of 50 mm and a length of 50 mm. When the sandwiched flat plate was pressed by a pressure of 100 MPa, the flat plate was not damaged at all. Thus, the formed flat plate had extremely high strength against an external force perpendicular to the flat surface of the flat plate unlike an existing ceramics-based magnetic core material such as an Ni—Zn based ferrite.

Forming of a Flat Plate of the Magnetic Core of Example 1

The preliminarily body was cut into a plurality of rectangular shapes each having a width of 15 mm and a length of 11 mm by using a trimming die so that a plurality of sheets was formed. A predetermined number of the sheets was stacked and inserted into a metal die. The sheets in the metal die were pressure-molded one hour-long by forming pressure of 200 MPa at 150° C. so that a pressed body (flat plate) is obtained. The pressed body had a thickness of 0.9 mm.

Forming of the Magnetic Core of Example 1

Figure 16:
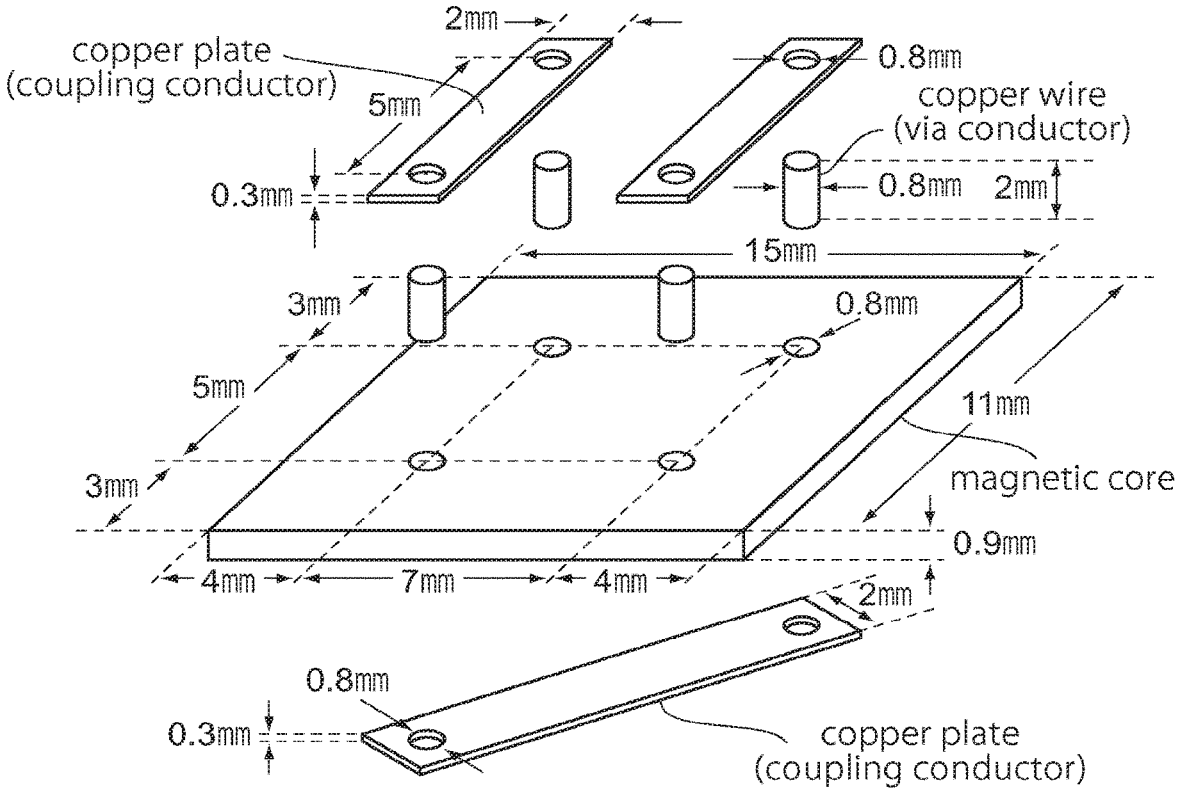
FIG. 16 is an exploded perspective view schematically showing components of an inductor of each of Examples 1 to 4 and Comparative Examples 1 to 6 of the present invention.

As shown in FIG. 16, the magnetic core of the inductor of Example 1 was formed by using the pressed body. In detail, the pressed body was formed with four via holes, or through holes at predetermined positions thereof by drill cutting. Each of the through holes had a diameter of 0.8 mm. Then, the pressed body was exposed to one hour heat-treatment at 600° C. under a nitrogen atmosphere so that the magnetic core was formed. The thus-formed magnetic core had a density of 4.9 g/cm$^3$ and volume resistivity (electric resistivity) of 10 KΩ·cm or more. A volume filling ratio (volume ratio) of the metal component (flat powder) in the magnetic core was calculated by using the density of the magnetic core. The volume filling ratio of the metal component was about 67 vol %.

Forming of the Magnetic Cores of Comparative Examples 1 to 3

Magnetic core components 1 to 3, or three types of commercial Ni—Zn based ferrite sintered bodies were used as the magnetic cores of the inductors of Comparative Examples 1 to 3, respectively. The magnetic core components 1 to 3 had real number components of 200, 260 and 550, respectively, for relative permeability at frequency of 1 MHz. Each of the magnetic core components 1 to 3 had volume resistivity (electric resistivity) of 10 KΩ·cm or more. Each of the magnetic core components 1 to 3 was cut and polished in a thickness direction to have a plate-like shape having a width of 15 mm, a length of 11 mm and a thickness of 0.9 mm. As shown in FIG. 16, each of the plate-like sintered bodies was formed with four via holes, or through holes at predetermined positions thereof by ultrasonic processing. Each of the through holes had a diameter of 0.8 mm. By the aforementioned process, the magnetic cores of Comparative Examples 1 to 3 were formed. The magnetic core of each of Comparative Examples 1 to 3 was made of an Ni—Zn based ferrite to have satisfactory high-frequency characteristics.

Forming of Conductive Components of the Coil of Each of Example 1 and Comparative Examples 1 to 3

As shown in FIG. 16, a plurality of copper wires, each of which did not have an insulating coating, was formed. Each of the copper wires had a cylindrical shape having a diameter of 0.8 mm and a length of 1.8 mm. The thus-formed copper wire was used as a via conductor, or a piercing portion of the coil to be inserted into the via hole of the magnetic core. A plurality of coupling conductors of the coil was also formed. In detail, the coupling conductors were formed of copper plates, respectively. Each of the copper plates did not have an insulating coating and had a width of 2 mm and a thickness of 0.3 mm. The copper plate was cut to have a predetermined length. The thus-cut copper plate was formed with holes at predetermined positions thereof by drill cutting. Each of the holes had a diameter of 0.8 mm.

Forming of the Inductors of Example 1 and Comparative Examples 1 to 3

Figure 17:
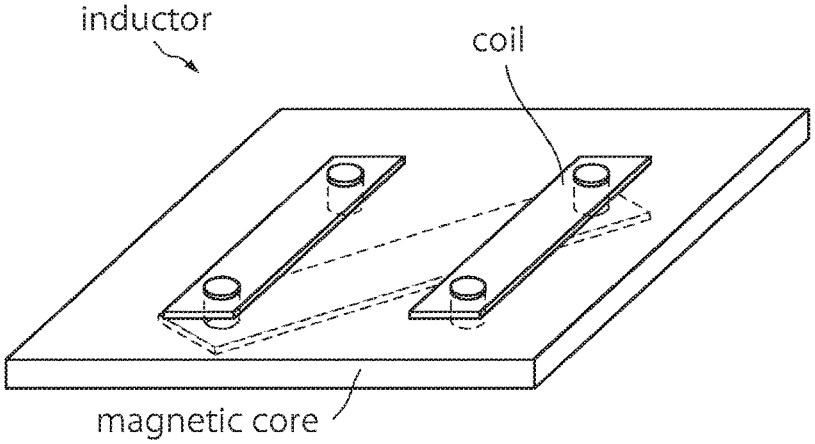
FIG. 17 is a perspective view schematically showing the inductor of each of Examples 1 to 3 and Comparative Examples 1 to 6 of the present invention.

As can be seen from FIGS. 16 and 17, the via conductors were inserted into the respective via holes of the magnetic core of Example 1. The coupling conductors were arranged on upper and lower surfaces of the magnetic core in such manner that the holes of the coupling conductor overlapped the respective via conductors. The magnetic core, the via conductors and the coupling conductors, which were thus arranged, were sandwiched between two stainless boards. The stainless boards were applied with a pressure of 15 kgf so that the via conductor and the coupling conductor were joined to each other. The via conductor was formed with a joined portion that was thus joined to the coupling conductor. The joined portion of the via conductor was largely deformed by the pressure. In detail, the joined portion had a diameter larger than the initial diameter of 0.8 mm. As shown in FIG. 17, the inductor of Example 1 was formed by the aforementioned process. Similar to the inductor of Example 1, the inductors of Comparative Examples 1 to 3 were formed by using the magnetic cores of Comparative Examples 1 to 3, respectively.

Measuring of Characteristics of the Inductors of Example 1 and Comparative Examples 1 to 3

Inductance at frequency of 1 MHz, frequency characteristics of inductance and thermal conductivity were measured for each of the inductors of Example 1 and Comparative Examples 1 to 3. The inductance at frequency of 1 MHz was measured by using an LCR meter, namely, HP-4284A of Agilent Technologies, Inc. The frequency characteristics of inductance were measured by using an impedance analyzer, namely, HP-4294A of Agilent Technologies, Inc. The thermal conductivity was measured by using FTC-1 of ULVAC-RIKO Inc.

Figure 19:
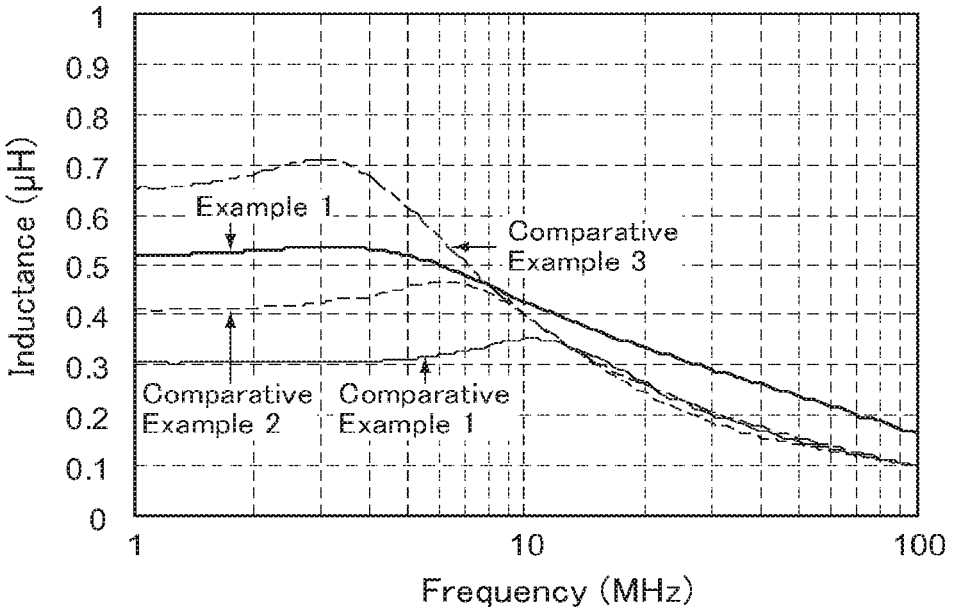
FIG. 19 is a graph showing inductance versus frequency for the inductors of Example 1 and Comparative Examples 1 to 3 of the present invention.

Characteristics of Each of Example 1 and Comparative Examples 1 to 3: Inductance and Frequency Characteristics of Inductance As shown in FIG. 19, the inductor of Example 1 of the present invention had the inductance equivalent to that of the Ni—Zn based ferrite inductor, or the inductor of each of Comparative Examples 1 to 3. Moreover, the inductance of the inductor of Example 1 was not lowered at a frequency lower than about 4 MHz by eddy current loss or the like. Moreover, the inductor of Example 1 had high inductance, even at high frequency, equal to or higher than those of the inductors of Comparative Examples 1 to 3 each of which had superior high-frequency characteristics.

Figure 20:
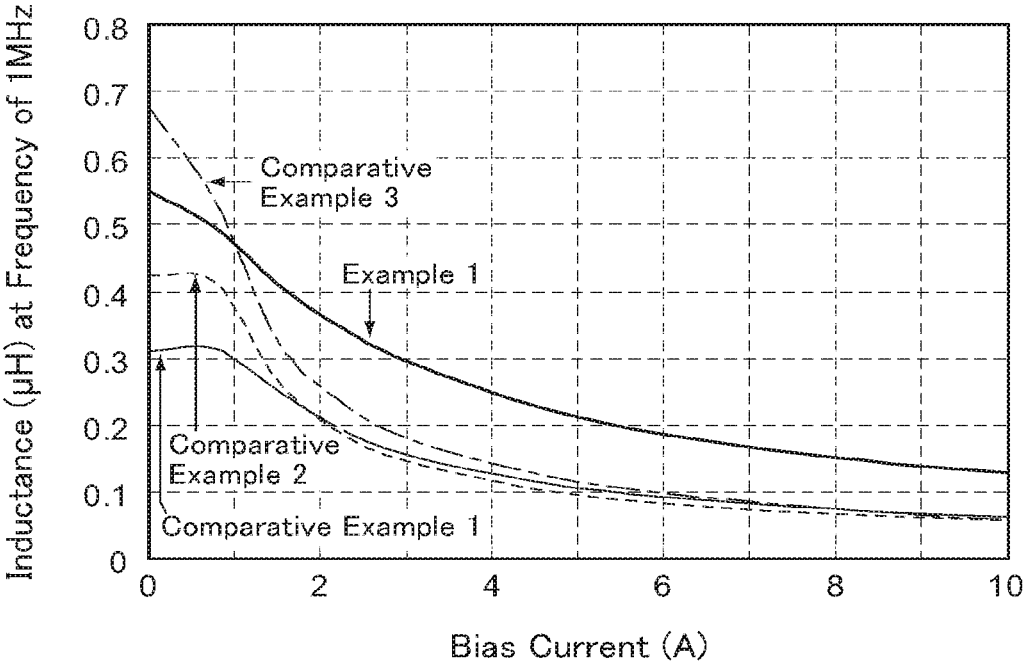
FIG. 20 is a graph showing inductance versus bias current for the inductors of Example 1 and Comparative Examples 1 to 3 of the present invention.

Characteristics of Each of Example 1 and Comparative Examples 1 to 3: Inductance Versus Bias Current As shown in FIG. 20, the inductance of the inductor of Example 1 was notably superior to those of the inductors of Comparative Examples 1 to 3 when a large bias current was applied to the coil. For example, under a state where a bias current of 5 A was applied, the inductance of the inductor of Example 1 was about twice of that of the inductor of each of Comparative Examples 1 to 3. The inductor of Example 1 had the aforementioned high inductance because the magnetic core of the inductor of Example 1 was made of the metal powder having a saturation magnetic flux density higher than that of the Ni—Zn based ferrite. As can be seen from the above explanation, the inductance of the inductor of Example 1 was hardly to be lowered even when a large current was supplied to the coil. Accordingly, the inductor of Example 1 is suitable to an inductor which is supplied with a large current.

Characteristics of Each of Example 1 and Comparative Examples 1 to 3: Thermal Conductivity The inductor of Example 1 has thermal conductivity of 7.5 W/m·K, while each of the inductors of Comparative Examples 1 to 3 had thermal conductivity between 3.5 W/m·K and 4.5 W/m·K. In other words, the thermal conductivity of the inductor of Example 1 was about twice of the thermal conductivity of each of the inductors of Comparative Examples 1 to 3.

As can be seen from the above explanation, in comparison with the existing Ni—Zn based ferrite inductor, the inductor according to the present invention had the high strength, the inductance which was hardly to be lowered even when being supplied with a large current, and the high thermal conductivity. Accordingly, the inductor according to the present invention can be used as the inductor of each of the modules of the aforementioned various embodiments.

Next, explanation is made about a magnetic core and an inductor of each of Example 2 and Comparative Examples 4 to 6.

Forming of a Preliminarily Body of the Magnetic Core of Example 2

A soft magnetic metal powder was used as a material of a preliminarily body of Example 2. In detail, a gas-atomized powder made of an Fe—Si—Al based alloy (sendust) was used. The powder had an average grain diameter (D50) of 55 μm. The powder was flatten by using a ball-mill. In detail, after the powder was processed by 8 hours forging, the powder was exposed to 3 hours heat-treatment at 700° C. under a nitrogen atmosphere so that a flat powder, or a sendust powder having flat-like shape was obtained. Then, the flat powder was mixed with a solvent, a viscosity improver and a thermoset binder component to form slurry. An ethanol was used as the solvent. A polyacrylic acid ester was used as the viscosity improver. A methyl silicone resin was used as the thermoset binder component. The slurry was applied on a PET film by using a slot die. Then, the solvent was volatilized by one hour drying at a temperature of 60° C. so that a preliminarily body was formed.

Forming of a Flat Plate of the Magnetic Core of Example 2

The preliminarily body was cut into a plurality of rectangular shapes each having a width of 15 mm and a length of 11 mm by using a trimming die so that a plurality of sheets was formed. A predetermined number of the sheets was stacked and inserted into a metal die. The sheets in the metal die were pressure-molded one hour-long by forming pressure of 20 kg/cm$^2$ at 150° C. so that a pressed body (flat plate) is obtained. The pressed body had a thickness of 0.9 mm.

Forming of the Magnetic Core of Example 2

As shown in FIG. 16, the magnetic core of the inductor of Example 2 was formed by using the pressed body. In detail, the pressed body was formed with four via holes, or through holes at predetermined positions thereof by drill cutting. Each of the through holes had a diameter of 0.8 mm. Then, the pressed body was exposed to one hour heat-treatment at 600° C. under a nitrogen atmosphere so that the magnetic core was formed. The thus-formed magnetic core had a density of 4.9 g/cm$^3$ and volume resistivity (electric resistivity) of 10 KΩ·cm or more. A volume filling ratio (volume ratio) of the metal component (flat powder) in the magnetic core was calculated by using the density of the magnetic core. The volume filling ratio of the metal component was about 67 vol %.

Forming of Conductive Components of the Coil of Each of Example 2 and Comparative Examples 4 to 6

As shown in FIG. 16, by the previously described forming process, the via conductors and the coupling conductors of each of Example 2 and Comparative Examples 4 to 6 were formed. For example, similar to Example 1, the via conductor was formed of the copper wire which did not have any insulating coating, and the coupling conductor was formed of the copper plate which did not have any insulating coating.

Forming of the Inductor of Example 2

As can be seen from FIGS. 16 and 17, the via conductors were inserted into the respective via holes of the magnetic core of Example 2. The coupling conductors were arranged on upper and lower surfaces of the magnetic core in such manner that the holes of the coupling conductor overlapped the respective via conductors. The magnetic core, the via conductors and the coupling conductors, which were thus arranged, were sandwiched between two stainless boards. The stainless boards were applied with a pressure of 15 kgf so that the via conductor and the coupling conductor were joined to each other. The via conductor was formed with a joined portion that was thus joined to the coupling conductor. The joined portion of the via conductor was largely deformed by the pressure. In detail, the joined portion had a diameter larger than the initial diameter of 0.8 mm. The inductor, which was formed as described above, was exposed to one hour heat-treatment at 650° C. under a nitrogen atmosphere so that the inductor of Example 2 was formed. The joined portion of the via conductor was diffused and welded to the coupling conductor by this heat-treatment so that the electric resistance at the joined portion was lowered.

Forming of the Inductors of Comparative Examples 4 to 6

The inductors of Comparative Examples 1 to 3 were formed by the previously described forming process. Then, the inductors of Comparative Examples 4 to 6 were formed of the inductors of Comparative Examples 1 to 3, respectively. In detail, similar to Example 2, the inductors of Comparative Examples 1 to 3 were exposed to one hour heat-treatment at 650° C. under a nitrogen atmosphere so that the inductors of Comparative Examples 4 to 6 were formed.

Each rate of damaged inductors upon forming of the inductors of Example 2 and Comparative Examples 4 to 6 is shown in Table 3.

TABLE 3

| | Rate of Damaged Inductors Upon Forming of Inductors (Number of Damaged Inductors/ Number of Formed Inductors) |
|---|---|
| Example 2 | 0/10 |
| Comparative Example 4 | 7/10 |
| Comparative Example 5 | 8/10 |
| Comparative Example 6 | 8/10 |

Measuring of Characteristics of the Inductors of Example 2 and Comparative Examples 4 to 6

Inductance at frequency of 1 MHz and frequency characteristics of inductance were measured for each of the inductors of Example 2 and Comparative Examples 4 to 6. The inductance at frequency of 1 MHz was measured by using an LCR meter, namely, HP-4284A of Agilent Technologies, Inc. The frequency characteristics of inductance were measured by using an impedance analyzer, namely, HP-4294A of Agilent Technologies, Inc.

Figure 21:
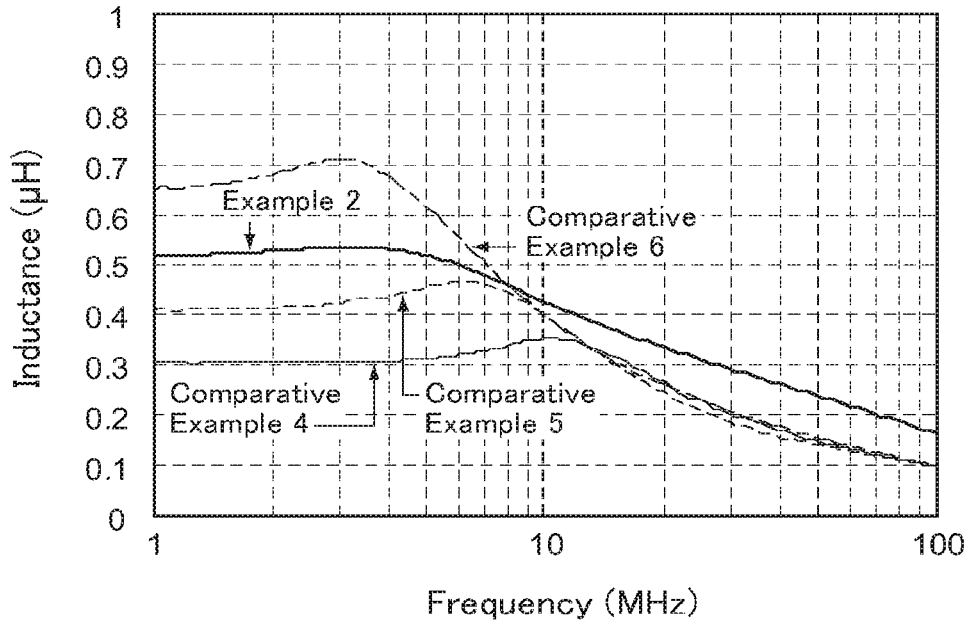
FIG. 21 is a graph showing inductance versus frequency for the inductors of Example 2 and Comparative Examples 4 to 6 of the present invention.

Characteristics of Each of Example 2 and Comparative Examples 4 to 6: Inductance and Frequency Characteristics of Inductance As shown in FIG. 21, the inductor of Example 2 of the present invention had inductance equivalent to that of the Ni—Zn based ferrite inductor, or the inductor of each of Comparative Examples 4 to 6. Moreover, the inductance of the inductor of Example 2 was not lowered at a frequency lower than about 4 MHz by eddy current loss or the like. Moreover, the inductor of Example 2 had high inductance, even at high frequency, equal to or higher than those of the inductors of Comparative Examples 4 to 6 each of which had a superior high-frequency characteristics. Moreover, as can be understood from the measurement result of Example 2 shown in FIG. 21, although the inductor of Example 2 was heat-treated at high temperature under a state where a coil portion formed of the via conductors and the coupling conductors was closely attached to the magnetic core, the coil portion was not short circuited.

Inductance under a bias current of 5 A for each of the inductors of Example 2 and Comparative Examples 4 to 6 is shown in Table 4.

TABLE 4

| | Inductance at Frequency of 1 MHz and under Bias Current of 5 A (μH) |
|---|---|
| Example 2 | 0.21 |
| Comparative Example 4 | 0.1 |
| Comparative Example 5 | 0.105 |
| Comparative Example 6 | 0.115 |

Figure 22:
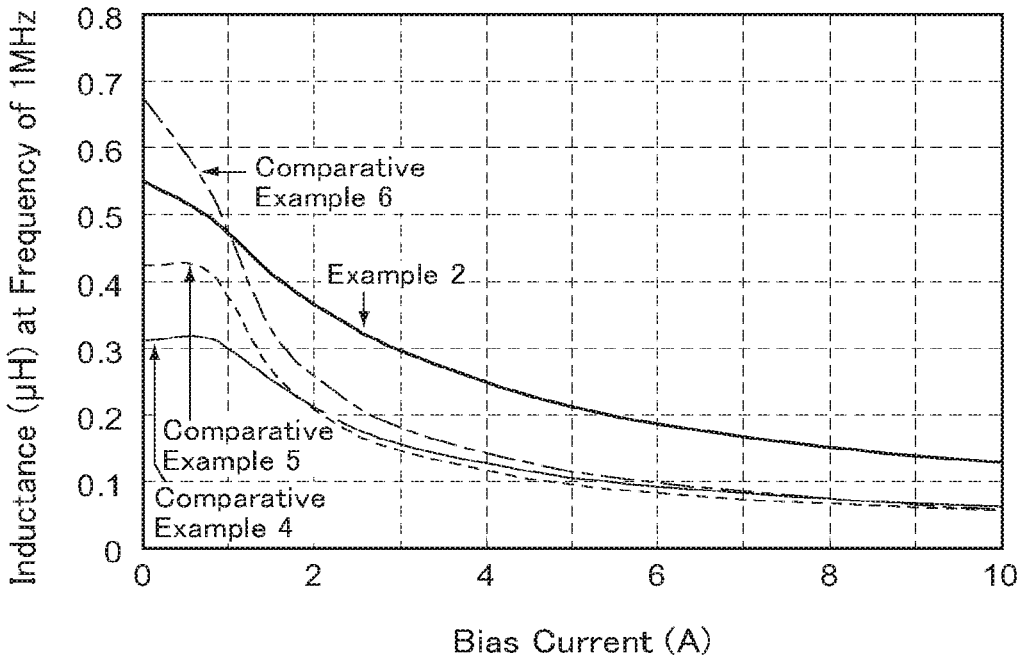
FIG. 22 is a graph showing inductance versus bias current for the inductors of Example 2 and Comparative Examples 4 to 6 of the present invention.

Characteristics of Each of Example 2 and Comparative Examples 4 to 6: Inductance Versus Bias Current As shown in FIG. 22 and Table 4, the inductance of the inductor of Example 2 was notably superior to those of the inductors of Comparative Examples 4 to 6, or the inductors each formed of an Ni—Zn based ferrite magnetic core when a large bias current was applied to the coil. For example, under a state where a bias current of 5 A was applied, the inductance of the inductor of Example 2 was about twice of that of the inductor of each of Comparative Examples 4 to 6. The inductor of Example 2 had the aforementioned high inductance because the magnetic core of the inductor of Example 2 was made of the metal powder having a saturation magnetic flux density higher than that of the Ni—Zn based ferrite. As can be seen from the above explanation, the inductance of the inductor of Example 2 was hardly to be lowered even when a large current was supplied to the coil. Accordingly, the inductor of Example 2 is suitable to an inductor which is supplied with a large current.

Next, explanation is made about a magnetic core and an inductor of each of Examples 3 and 4.

Forming of a Metal Powder of the Magnetic Core of Each of Examples 3 and 4

A soft magnetic metal powder was used as a material of a preliminarily body of each of Examples 3 and 4. In detail, a gas-atomized powder made of an Fe—Si—Al based alloy (sendust) was used. The powder had an average grain diameter (D50) of 55 μm. The powder was flatten by using a ball-mill. In detail, after the powder was processed by 8 hours forging, the powder was exposed to 3 hours heat-treatment at 700° C. under a nitrogen atmosphere so that a flat powder, or a sendust powder having flat-like shape was obtained. An average major axis (Da), an average maximum thickness (ta) and an average aspect ratio (Da/ta) of the thus-formed flat powder were measured. In detail, the flat powder was impregnated with a resin to be hardened. Thus, a hardened body was formed. Then, the hardened body was polished. Then, a scanning electron microscope was used to examine shapes of flat metal particles located on the polished surface of the hardened body. In detail, a major axis (D) and a maximum thickness (t) at the thickest part were measured for each of the thirty flat metal particles. Each aspect ratio (D/t) was calculated from the major axis (D) and the maximum thickness (t). The thus-obtained aspect ratios (D/t) were averaged so that the average aspect ratio (Da/ta) was obtained. The average major axis (Da) was 60 μm. The average maximum thickness (ta) was 3 μm. The average aspect ratio (Da/ta) was 20.

Forming of the Preliminarily Body of the Magnetic Core of Each of Examples 3 and 4

The flat powder was mixed with a solvent, a viscosity improver and a thermoset binder component to form slurry. An ethanol was used as the solvent. A polyacrylic acid ester was used as the viscosity improver. A methyl silicone resin was used as the thermoset binder component. The slurry was applied on a PET film by using a slot die. Then, the solvent was volatilized by one hour drying at a temperature of 60° C. so that the preliminarily body of each of Examples 3 and 4 was formed.

Forming of a Flat Plate of the Magnetic Core of Example 3

The preliminarily body was cut into a plurality of rectangular shapes each having a width of 15 mm and a length of 11 mm by using a trimming die so that a plurality of sheets was formed. A predetermined number of the sheets was stacked and inserted into a metal die. The sheets in the metal die were pressure-molded one hour-long by forming pressure of 2 MPa at 150° C. so that a pressed body (flat plate) is obtained. The pressed body had a thickness of 0.9 mm.

Forming of the Magnetic Core of Example 3

As shown in FIG. 16, the magnetic core of the inductor of Example 3 was formed by using the pressed body. In detail, the pressed body was formed with four via holes, or through holes at predetermined positions thereof by drill cutting. Each of the through holes had a diameter of 0.8 mm. Then, the pressed body was exposed to one hour heat-treatment at 650° C. under a nitrogen atmosphere so that the magnetic core of Example 3 was formed. The thus-formed magnetic core had a density of 4.9 g/cm$^3$ and volume resistivity (electric resistivity) of 10 KΩ·cm or more. The volume filling ratio (volume ratio) of the metal component (flat powder), a volume filling ratio (volume ratio) of the heat-treated binder component (binder component) and porosity of the vacancy in the magnetic core were calculated by using the density of the magnetic core. The volume filling ratio of the metal component was about 67 vol %. The volume filling ratio of the binder component, which was the hardened methyl silicone resin, or the binder component made of a glass material including a silicon oxide as a principal component, was about 18 vol %. The porosity was about 15 vol %. The viscosity improver was almost completely decomposed by the aforementioned heat-treatment not to remain in the magnetic core.

Forming of Conductive Components of the Coil of Example 3

As shown in FIG. 16, by the previously described forming process, the via conductors and the coupling conductors of Example 3 were formed.

Forming of the Inductor of Example 3

As can be seen from FIGS. 16 and 17, similar to Examples 1 and 2, the inductor of Example 3 was formed.

Forming of the Magnetic Core of Example 4

The preliminarily body of Example 4 was cut into a plurality of rectangular shapes each having a width of 15 mm and a length of 11 mm by using a trimming die so that a plurality of sheets was formed. A predetermined number of the sheets was stacked and inserted into a metal die. The sheets in the metal die were pressure-molded one hour-long by forming pressure of 2 MPa at 150° C. so that a pressed body (flat plate) is obtained. The pressed body had a thickness of 0.9 mm. The pressed body was exposed to one hour heat-treatment at 650° C. under a nitrogen atmosphere so that the magnetic core of Example 4 was formed.

Forming of Via Conductors of the Coil of Example 4

Figure 18A:
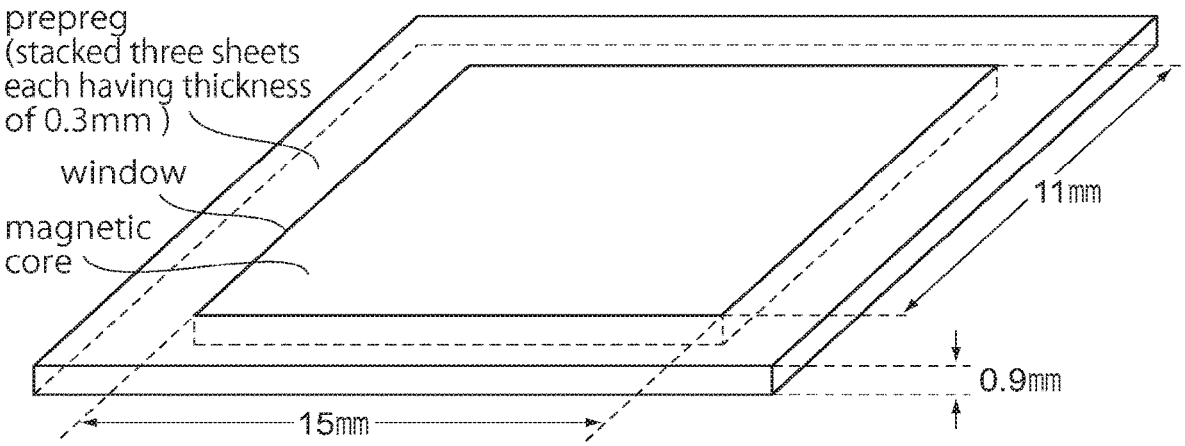
FIG. 18A is a perspective view schematically showing a magnetic core of Example 4 of the present invention and a prepreg holding the magnetic core.
Figure 18B:
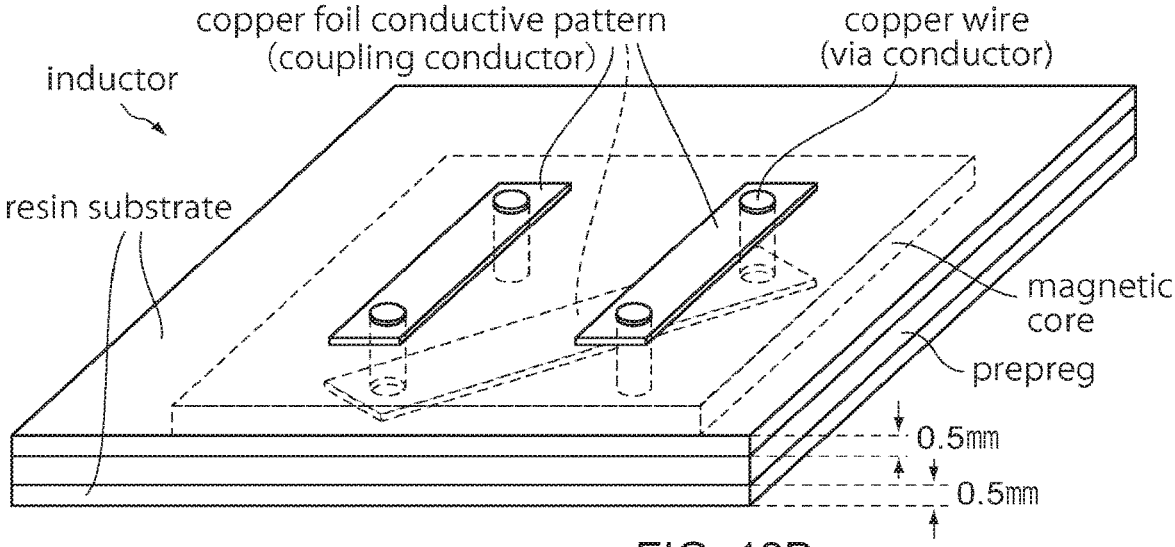
FIG. 18B is a perspective view schematically showing the inductor of Example 4 of the present invention.

As can be seen from FIGS. 16 and 18B, by the forming process similar to the previously described forming process, the via conductors of Example 4 were formed.

Forming of the Inductor of Example 4

As shown in FIG. 18A, three sheets, or three sheet-like prepregs each having a thickness of 0.3 mm were prepared. Each of the sheets was formed with a rectangular opening having a width of 15 mm and a length of 11 mm. The thus-formed three sheets were stacked to form a prepreg having a thickness of 0.9 mm. The magnetic core of Example 4 was placed within the opening of the prepreg. As shown in FIG. 18B, two resin substrates each having a thickness of 0.5 mm were prepared. Each of the resin substrates was a one-sided copper foiled substrate. In detail, each of the resin substrates had a foiled side formed with one or more conductive patterns (coupling conductors) each made of a copper foil. The two resin substrates were arranged on upper and lower surfaces of the prepreg and the magnetic core so that a stacked body was formed. In detail, the foiled side of one of the resin substrates was located on an upper surface of the stacked body, while the foiled side of remaining one of the resin substrates was located on a lower surface of the stacked body. The thus-formed laminated body was pressure-molded one hour-long by forming pressure of 3 MPa at 180° C. The inductor of Example 4 was formed of the thus-pressed stacked body (pressed body). In detail, the pressed body was formed with four via holes, or through holes at predetermined positions thereof by drill cutting (see FIGS. 16 and 18B). Each of the through holes had a diameter of 0.8 mm. Then, the via conductors, each of which was made of a copper to have a diameter of 0.8 mm, were inserted into the respective via holes. The via conductor and the conductive pattern of the resin substrate were joined to each other by soldering so that the inductor of Example 4 was formed. As shown in FIG. 18B, the magnetic core of Example 4 was placed within the stacked resin substrates including the prepreg.

Measuring of Characteristics of the Inductors of Examples 3 and 4

Inductance at frequency of 1 MHz and frequency characteristics of inductance were measured for each of the inductors of Examples 3 and 4. The inductance at frequency of 1 MHz was measured by using an LCR meter, namely, HP-4284A of Agilent Technologies, Inc. The frequency characteristics of inductance were measured by using an impedance analyzer, namely, HP-4294A of Agilent Technologies, Inc.

Figure 23:
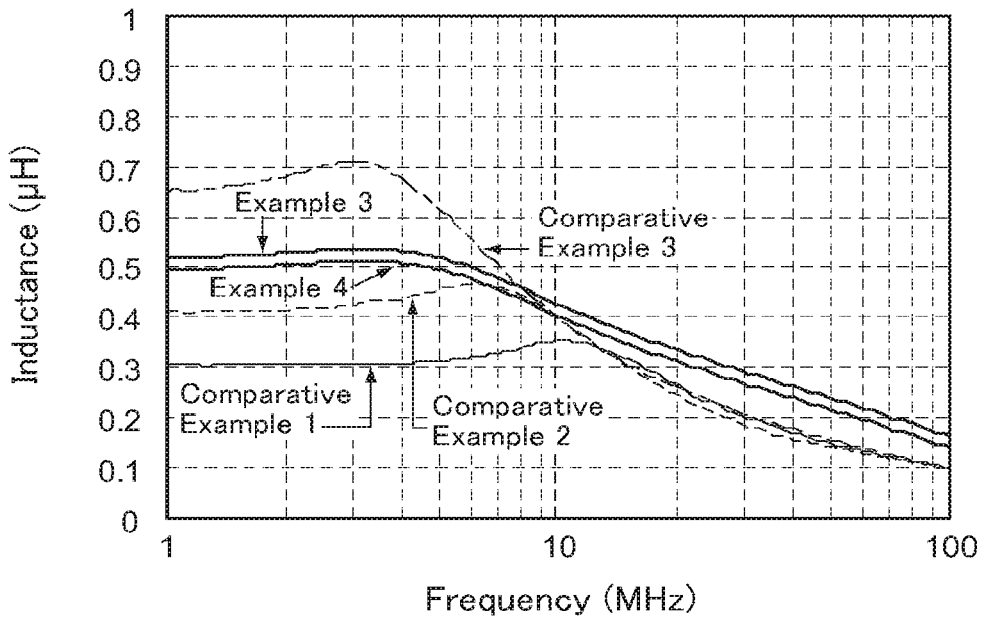
FIG. 23 is a graph showing inductance versus frequency for the inductors of Examples 3 and 4, and Comparative Examples 1 to 3 of the present invention.

Characteristics of Each of Example 4 and Comparative Examples 1 to 3: Inductance and Frequency Characteristics of Inductance As shown in FIG. 23, the inductor of Example 4 of the present invention had inductance equivalent to that of the Ni—Zn based ferrite inductor, or the inductor of each of Comparative Examples 1 to 3. Moreover, the inductance of the inductor of Example 4 was not lowered at a frequency lower than about 4 MHz by eddy current loss or the like. Moreover, the inductor of Example 4 had high inductance, even at high frequency, equal to or higher than those of the inductors of Comparative Examples 1 to 3 each of which had a superior high-frequency characteristics.

Figure 24:
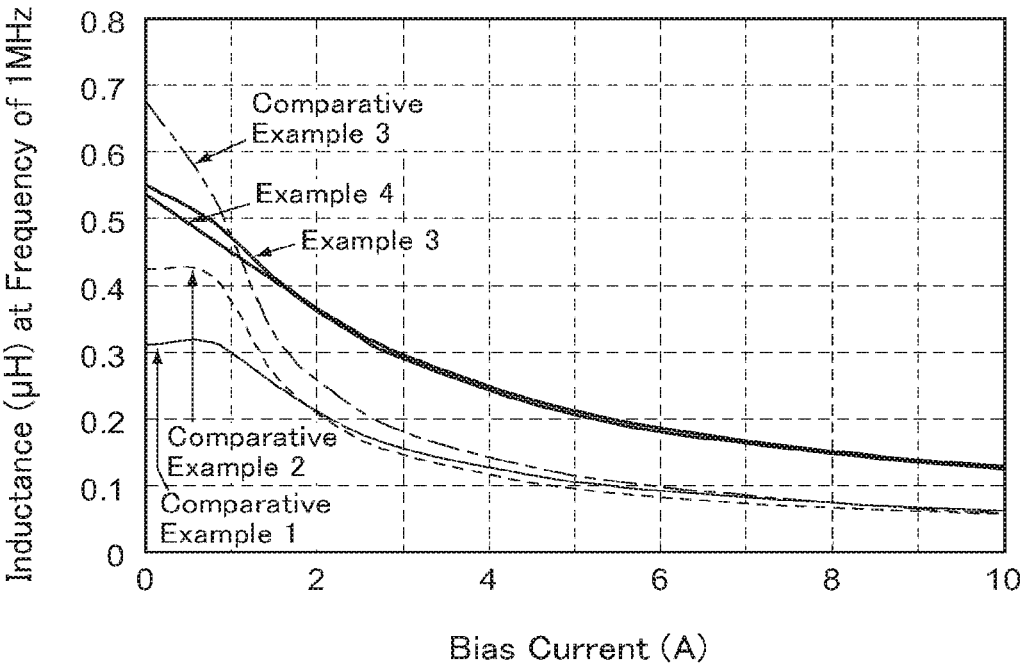
FIG. 24 is a graph showing inductance versus bias current for the inductors of Examples 3 and 4, and Comparative Examples 1 to 3 of the present invention.

Characteristics of Each of Example 4 and Comparative Examples 1 to 3: Inductance Versus Bias Current As shown in FIG. 24, the inductance of the inductor of Example 4 was notably superior to those of the inductors of Comparative Examples 1 to 3, or the inductors each formed of an Ni—Zn based ferrite magnetic core when a large bias current was applied to the coil. For example, under a state where a bias current of 5 A was applied, the inductance of the inductor of Example 4 was about twice of that of the inductor of each of Comparative Examples 1 to 3. The inductor of Example 4 had the aforementioned high inductance because the magnetic core of the inductor of Example 4 was made of the metal powder having a saturation magnetic flux density higher than that of the Ni—Zn based ferrite. As can be seen from the above explanation, the inductance of the inductor of Example 4 was hardly to be lowered even when a large current was supplied to the coil. Accordingly, the inductor of Example 4 is suitable to an inductor which is supplied with a large current.

Characteristics of the Inductors of Examples 3 and 4

As shown in FIGS. 23 and 24, although the inductor of Example 4 included the magnetic core within the stacked resin substrates unlike the inductor of Example 3, the inductor of Example 4 had magnetic characteristics almost same as that of the inductor of Example 3. Thus, the magnetic core according to the present invention was not damaged even by the pressure applied when sandwiched between the resin substrates. Moreover, the superior magnetic characteristics of the magnetic core were kept after the magnetic core was sandwiched between the resin substrates.

The viscosity improver and the thermoset binder component such as an organic binder according to the present invention are not limited to those of the aforementioned Examples. For example, the specific organic binder may be properly prepared depending on the soft magnetic metal powder. Moreover, the addition amount of the organic binder may be properly adjusted depending on the soft magnetic metal powder. Moreover, when the addition amount of the thermoset binder component is adjusted in proportion to the surface area of the soft magnetic metal powder, satisfactory effect similar to the aforementioned Examples can be obtained.

Although each conductor, which is used as the coil portion in the aforementioned Examples and Comparative Examples, does not have any insulating coating, a conductor, which has an insulating coating formed at predetermined portion, may be used. Moreover, when the via conductor and the coupling conductor are joined to each other by the pressing force, the joining process may be accelerated by a simultaneous fusing or applying of pulsed electric-current. Moreover, the joined portion may not be diffused nor welded by the heat-treatment. On contrary, the diffusing and the welding may be accelerated as necessary by interposing nano metal powder particles to the joined portion.

The present application is based on Japanese patent applications of JP2013-019649 filed before the Japan Patent Office on Feb. 4, 2013 and JP2013-198965 filed before the Japan Patent Office on Sep. 25, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A module comprising:

a circuit board having a facing surface and a rear surface which are located at opposite sides to each other in an up-down direction; and an inductor having a magnetic core and a coil, the magnetic core being made of a soft magnetic metal material, the magnetic core having a facing surface and a radiating surface which are located at opposite sides to each other in the up-down direction, the facing surface of the magnetic core being arranged to face the facing surface of the circuit board in the up-down direction, the radiating surface of the magnetic core being arranged to radiate heat outward, the coil having a coil portion and two connection ends, the coil portion winding, at least in part, the magnetic core, and the connection ends being connected to the facing surface of the circuit board;

wherein:

the inductor is connected to the facing surface of the circuit board only at the two connection ends of the coil;

the facing surface of the circuit board has two connection portions;

the two connection ends are connected to the two connection portions, respectively, of the facing surface of the circuit board;

the magnetic core has a plurality of through holes;

the coil has two connection portions;

the two connection portions of the coil have the two connection ends, respectively;

the coil portion has a plurality of piercing portions; and two of the piercing portions, which are farthest from each other among the piercing portions, extend downwardly in the up-down direction from the through holes to be formed with the two connection portions, respectively, of the coil.

2. The module as recited in claim 1, wherein the radiating surface of the magnetic core is exposed, at least in part, outward of the module.

3. The module as recited in claim 1, wherein the radiating surface of the magnetic core is in contact, at least in part, with a cooling member outside of the module.

4. The module as recited in claim 1, wherein:

the magnetic core is formed to be elastically deformable;

the coil portion of the coil pierces the through hole while elastically deforming an inner wall of the through hole; and the coil is held by a pressing force which is applied to the coil portion from the inner wall of the through hole.

5. The module as recited in claim 1, the module further comprising a radiating member, wherein the radiating member is attached to the radiating surface of the magnetic core.

6. The module as recited in claim 5, the module further comprising a coupling member made of a thermal conductor, wherein the coupling member couples the circuit board with the radiating member via the magnetic core.

7. The module as recited in claim 5, wherein the radiating member is in contact, at least in part, with a cooling member outside of the module.

8. The module as recited in claim 1, wherein an electronic component is mounted on the facing surface of the circuit board.

9. The module as recited in claim 1, wherein any electronic component is not mounted on the facing surface of the circuit board.

10. The module as recited in claim 1, wherein the module is a power module for supplying electric power outward of the module.

11. The module as recited in claim 1, wherein:

the soft magnetic metal material is a soft magnetic metal powder having flat-like shape; and the magnetic core is made of the soft magnetic metal powder bound by an insulating material.

12. The module as recited in claim 11, wherein the magnetic core includes the soft magnetic metal powder of 55 vol % or more.

13. The module as recited in claim 11, wherein the magnetic core includes the soft magnetic metal powder of 60 vol % or more.

14. The module as recited in claim 11, wherein the magnetic core includes the soft magnetic metal powder of 70 vol % or more.

15. The module as recited in claim 11, wherein the magnetic core has electric resistivity of 10 KΩ·cm or more.

* * * * *